US011031688B2

(12) United States Patent
Ramasamy et al.

(10) Patent No.: US 11,031,688 B2
(45) Date of Patent: Jun. 8, 2021

(54) SYSTEM AND METHOD FOR OPERATING AN ANTENNA ADAPTATION CONTROLLER MODULE

(71) Applicant: Dell Products, LP, Round Rock, TX (US)

(72) Inventors: Suresh K. Ramasamy, Austin, TX (US); Youngsoo Cho, Cedar Park, TX (US); Adolfo S. Montero, Pflugerville, TX (US); Ching Wei Chang, Cedar Park, TX (US); Ricardo R. Velasco, Cumming, GA (US); Geroncio O. Tan, Austin, TX (US); Lars Fredrik Proejts, Zhongshan District (TW); Jian Xin Guo, Austin, TX (US); Stephen Shiao, Coral Springs, FL (US); Wei-Chia Huang, Taipei (TW)

(73) Assignee: Dell Products, LP, Round Rock, TX (US)

( * ) Notice: Subject to any disclaimer, the term of this patent is extended or adjusted under 35 U.S.C. 154(b) by 444 days.

(21) Appl. No.: 15/803,571

(22) Filed: Nov. 3, 2017

(65) Prior Publication Data

US 2019/0140340 A1 May 9, 2019

(51) Int. Cl.
*H01Q 3/00* (2006.01)
*H01Q 3/26* (2006.01)
(Continued)

(52) U.S. Cl.
CPC ..... *H01Q 3/26* (2013.01); *H01Q 1/1257* (2013.01); *H01Q 1/2291* (2013.01);
(Continued)

(58) Field of Classification Search
CPC .... H01Q 1/2291; H01Q 1/007; H01Q 1/1257; H01Q 3/26; H01Q 3/28; H01Q 3/34; H01Q 25/00; H01Q 25/007
(Continued)

(56) References Cited

U.S. PATENT DOCUMENTS 6,040,803 A 3/2000 Spall
6,509,865 B2 * 1/2003 Takai ..... H01Q 1/246 342/14

(Continued)

*Primary Examiner* — Chuong P Nguyen
(74) *Attorney, Agent, or Firm* — Prol Intellectual Property Law, PLLC; H. Kenneth Prol

(57) ABSTRACT

A wireless adapter front end system and method for an information handling system including a wireless adapter for communicating on a plurality antenna systems for connection to a plurality of wireless links and an antenna configurable to have a plurality of antenna radiation patterns via an antenna pattern steering control interface, wherein the antenna is operating in a first antenna radiation pattern. An antenna adaptation controller executing code instructions for steering the antenna radiation pattern based upon a plurality of antenna trigger inputs, wherein the antenna trigger inputs include WLAN signal state feedback data and information handling system physical configuration data for configuration of the antenna system relative to a display screen and base housing of the information handling system, the antenna adaptation controller receiving the antenna trigger inputs and selecting a second antenna radiation pattern for comparing a WLAN radio link signal levels of the second antenna radiation pattern to the first antenna radiation pattern, and the antenna adaptation controller setting the second antenna radiation pattern as the highest if the WLAN radio link signal level of the second antenna radiation pattern is greater than the WLAN radio link signal level of the first antenna radiation pattern.

20 Claims, 8 Drawing Sheets

(51) Int. Cl.

| | |
|---|---|
| ***H01Q 1/22*** | (2006.01) |
| ***H01Q 25/00*** | (2006.01) |
| ***H01Q 1/12*** | (2006.01) |
| *H01Q 3/34* | (2006.01) |
| *H01Q 3/28* | (2006.01) |
| *H01Q 1/00* | (2006.01) |

(52) U.S. Cl.
CPC ..... *H01Q 25/00* (2013.01); *H01Q 1/007* (2013.01); *H01Q 3/28* (2013.01); *H01Q 3/34* (2013.01); *H01Q 25/007* (2013.01)

(58) Field of Classification Search
USPC ..... 342/368, 372
See application file for complete search history.

(56) References Cited

U.S. PATENT DOCUMENTS

| | | | | |
|---|---|---|---|---|
| 6,765,536 | B2 | 7/2004 | Phillips | |
| 6,891,506 | B2 | 5/2005 | Jarmuszewski | |
| 6,917,338 | B2 | 7/2005 | Bergervoet | |
| 7,132,989 | B1 | 11/2006 | Poilasne | |
| 7,236,759 | B2 * | 6/2007 | Cha | H04B 7/0408 455/275 |
| 7,649,407 | B2 | 1/2010 | Rohani | |
| 8,396,442 | B2 * | 3/2013 | Yamada | H01Q 3/26 455/337 |
| 9,398,639 | B2 * | 7/2016 | Salhov | H04B 7/0871 |
| 9,489,787 | B1 * | 11/2016 | Ives-Halperin | H04W 4/021 |
| 9,692,402 | B2 * | 6/2017 | Wagh | H03K 5/26 |
| 9,793,963 | B2 * | 10/2017 | Grau Besoli | H04B 7/0617 |
| 9,898,881 | B2 * | 2/2018 | Ives-Halperin | G06Q 30/0241 |
| 10,420,023 | B2 * | 9/2019 | Ramasamy | H01Q 25/04 |
| 10,601,473 | B2 * | 3/2020 | Khidre | H04B 1/525 |
| 2004/0135723 | A1 | 7/2004 | Nakaya | |
| 2011/0299431 | A1 | 12/2011 | Mikhemar | |
| 2011/0299438 | A1 | 12/2011 | Mikhemar | |
| 2013/0016024 | A1 | 1/2013 | Shi | |
| 2013/0107923 | A1 * | 5/2013 | Salhov | H04B 7/0413 375/222 |
| 2014/0210666 | A1 * | 7/2014 | Maltsev | H01Q 25/00 342/368 |
| 2015/0124713 | A1 * | 5/2015 | Salhov | H01Q 3/2605 370/329 |
| 2016/0191034 | A1 * | 6/2016 | Wagh | G01R 31/67 327/233 |
| 2020/0015161 | A1 * | 1/2020 | Ramasamy | H04W 52/243 |

* cited by examiner

SYSTEM AND METHOD FOR OPERATING AN ANTENNA ADAPTATION CONTROLLER MODULE

FIELD OF THE DISCLOSURE

The present disclosure generally relates to a method and apparatus for a WLAN RF front end solution for radio antenna systems used with information handling systems. In particular, the present disclosure relates to functionality for WLAN antenna operational adaptation via controller operation.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, and networking systems. Information handling systems can also implement various virtualized architectures. Data communications among information handling systems may be via networks that are wired, wireless, optical or some combination. For wireless communications, one or more wireless interface adapters may be used including antenna systems, a front end antenna module and other radio frequency subsystems. Users may choose from among several available radiofrequency communication platforms in information handling systems for data and other communications with other users via communication and data networks. Current radiofrequency communication platforms suffer from limited functionality, and may be under control of BIOS systems linked to specific operating systems.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

DETAILED DESCRIPTION OF THE DRAWINGS

Figure 1:
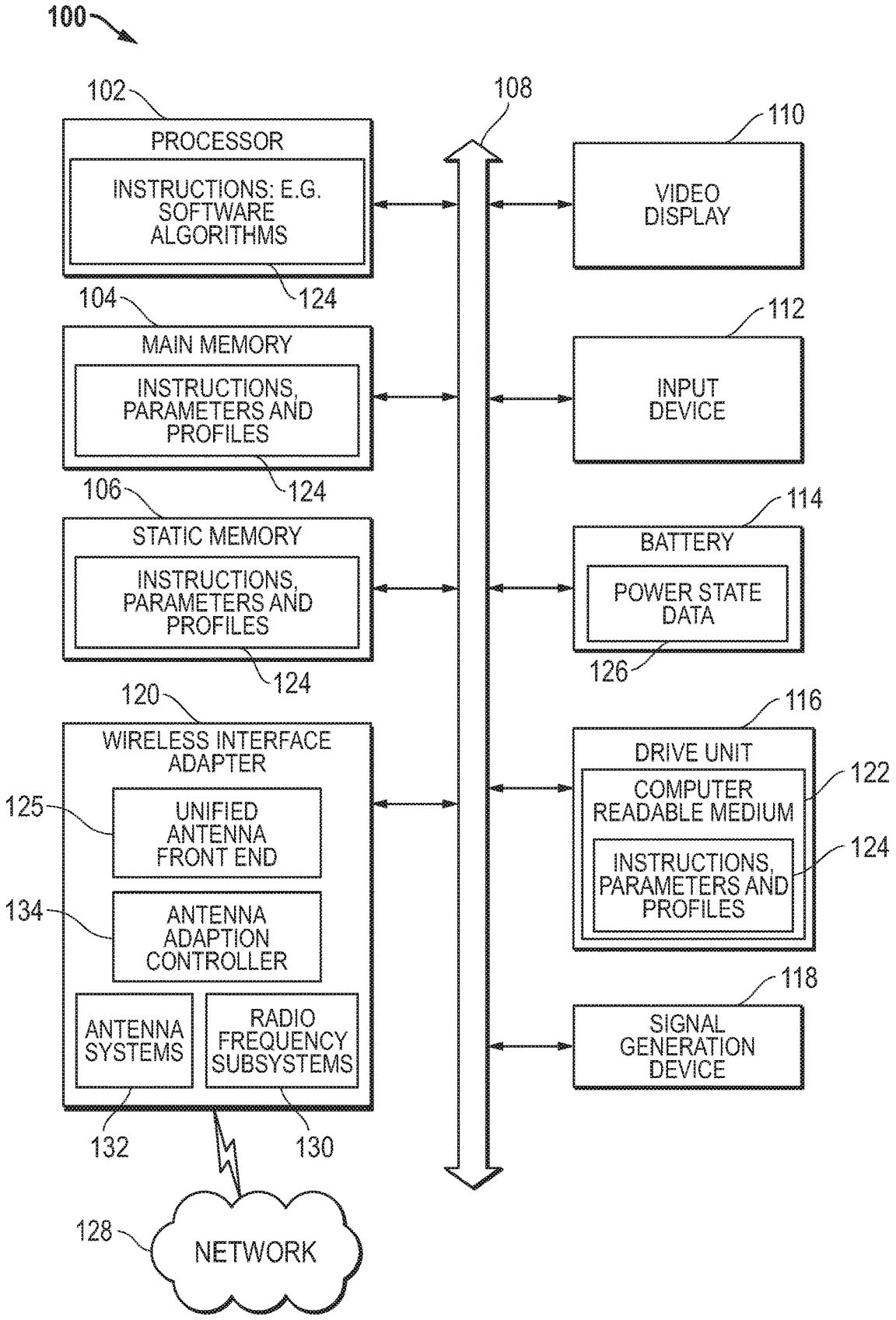
FIG. 1 is a block diagram illustrating an information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality. The information handling system may be of a variety of models and types. For example, a personal computer may be a laptop, a 360 convertible computing device, a tablet, smart phone, wearable computing device, or other mobile information handling system and may have several configurations and orientation modes. The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

In an aspect, the information handling system may have a plurality of antenna systems for communication via wireless links operating on a variety of radio access technologies (RAT). In another aspect, several antenna systems may be available for each RAT to enable aggregated data communications such as via plural multiple in, multiple out (MIMO) streams to enhance bandwidth or reliability. Antenna systems may be operated via one or more wireless adapters that may include controllers, memory and other subsystems some of which may operate as a radio frequency (RF) front end or wireless module for one or more antenna system to transmit wirelessly.

In some aspects, one wireless technology RAT that may be implemented is WLAN technologies such as WiFi under the IEEE 802.11 series of standards. Additionally, according to some aspects of the present disclosure, an antenna adaptation controller may be used with an RF front end and wireless module to support and enhance antenna operation according to several embodiments herein. Currently deployed WLAN antenna systems (or WWAN unlicensed spectrum or other small cell operation) may have fixed antenna patterns for operation and limited functionality. In reconfigurable information handling system and with dynamic operation of WLAN antenna systems in response to detected human proximity, WLAN radio signal conditions are subject to a variety of changes during operation with information handling systems. According to aspects of the present embodiments, a system is taught for maintaining optimal WLAN radio signal conditions in view of the detecting several antenna triggers that may indicate changes to the WLAN antenna system operation. A smart antenna system is provided to detect antenna triggers indicating WLAN antenna system changes as well as providing for WLAN antenna reconfiguration in some embodiments. It is understood that the embodiments disclosed herein may also be applicable to WWAN 5 GHz or other band operations for small cell LTE and similar LTE RATs. Further, an antenna adaptation controller may be used with an RF front end and wireless radio module such that the antenna adaptation controller may provide for such smart antenna operation for any antenna systems and wireless radio module supplied as part of a wireless adapter for information handling system in aspects of the embodiments herein. Information handling system manufacturers may face antenna systems supplied from a multitude of suppliers or designed for a wide variety of information handling system types or designs. An antenna adaptation controller that may be used across such a wide variety of antenna systems and with a variety of supplied RF front end or wireless radio module components. The antenna adaptation controller provides for an efficient and cost effective solution to dynamic changes to the WLAN radio signal (or WWAN radio signal) due to physical reconfigurations, SAR required power reductions, and other antenna trigger inputs. Improved WLAN or WWAN operation and reduced system costs may be provided when one or more WLAN/WWAN antenna systems are capable of being tuned and modified with respect to RF transmission patterns or selection between antennas to optimize WLAN/WWAN signals in view of a variety of antenna trigger inputs. Either or both strategies of tuning RF transmission patterns or selection between antennas may be used in various embodiments. An antenna adaptation controller according to embodiments herein may be used to make any WLAN antenna system or WWAN antenna system smart in finding optimized signal performance independent of operating system type or wireless adapter components or antennas supplied for an information handling system.

FIG. 1 shows an information handling system 100 capable of administering each of the specific embodiments of the present disclosure. The information handling system 100 can represent the mobile information handling systems 210, 220, and 230 or servers or systems located anywhere within network 200 of FIG. 2, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available RAT protocols including WLAN protocols. These application programs may operate in some example embodiments as software, in whole or in part, on an information handling system while other portions of the software applications may operate on remote server systems. The antenna adaptation controller 134 of the presently disclosed embodiments may operate as firmware or hardwired circuitry or any combination on controllers or processors within the information handing system 100 for interface with components of a wireless interface adapter 120. It is understood that some aspects of the antenna adaptation controller 134 described herein may interface or operate as software or via other controllers associated with the wireless interface adapter 120 or elsewhere within information handling system 100. Information handling system 100 may also represent a networked server or other system from which some software applications are administered or which wireless communications such as across WLAN or WWAN may be conducted. In other aspects, networked servers or systems may operate the antenna adaptation controller 134 for use with a wireless interface adapters 120 on those devices similar to embodiments for WLAN or WWAN antenna optimization operation according to according to various embodiments.

The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, a solid state display, or a cathode ray tube (CRT). Display 110 may include a touch screen display module and touch screen controller (not shown) for receiving user inputs to the information handling system 100. Touch screen display module may detect touch or proximity to a display screen by detecting capacitance changes in the display screen as understood by those of skill. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a 360 degree convertible device, a wearable computing device, or a mobile smart phone.

The information handling system 100 can include sets of instructions 124 that can be executed to cause the computer system to perform any one or more desired applications. In many aspects, sets of instructions 124 may implement wireless communications via one or more antenna systems 132 available on information handling system 100. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may software or firmware applications or algorithms which utilize one or more wireless links for wireless communications via the wireless interface adapter as well as other aspects or components. The antenna adaptation controller 134 may execute instructions as disclosed herein for monitoring wireless link state information, information handling system configuration data, SAR proximity sensor detection, or other input data to generate channel estimation and determine antenna radiation patterns. The antenna adaptation controller 134 may implement adjustments to wireless antenna systems and resources via RFIC front end 125 and WLAN or WWAN radio module systems within the wireless interface device 120. Aspects of the antenna optimization for the antenna adaptation controller 134 may be included as part of an antenna front end 125 in some aspects or may be included with other aspects of the wireless interface device 120 such as WLAN radio module such as part of the radio frequency subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify antenna radiation patterns and parasitic component operations. Multiple WLAN or WWAN antenna systems may operating on various communication frequency bands such as under IEEE 802.11a and IEEE 802.11g providing multiple band options for frequency channels. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects WLAN antenna adaptation controller may execute firmware algorithms or hardware to regulate operation of the one or more antenna systems 132 such as WLAN antennas in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software application instructions 124 or firmware instructions may be coordinated by an operating system (OS) and via an application programming interface (API). An example operating system may include Windows®, Android®, and other OS types known in the art. Example APIs may include Win 32, Core Java API, Android APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented in graphical processor units (GPUs) or controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Some memory or storage may reside in the wireless adapter 120. Further, the instructions 124 that embody one or more of the methods or logic as described herein. For example, instructions relating to the WLAN antenna adaptation system or antenna adjustments described in embodiments herein may be stored here or transmitted to local memory located with the antenna adaptation controller 134, antenna front end 125, or wireless module in radiofrequency subsystem 130 in the wireless interface adapter 120.

In a particular embodiment, the instructions, parameters, and profiles 124 may reside completely, or at least partially, within a memory, such as non-volatile static memory, during execution of antenna adaptation by the antenna adaptation controller 134 in wireless interface adapter 132 of information handling system 100. As explained, some or all of the WLAN antenna adaptation and antenna optimization may be executed locally at the antenna adaptation controller 134, RF front end 125, or wireless module subsystem 130. Some aspects may operate remotely among those portions of the wireless interface adapter or with the main memory 104 and the processor 102 in parts including the computer-readable media in some embodiments.

Battery 114 may include a smart battery system that tracks and provides power state data 126. This power state data may be stored with the instructions, parameters, and profiles 124 to be used with the systems and methods disclosed herein in determining WLAN antenna adaptation and antenna optimization in some embodiments.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more radio frequency subsystems 130 with transmitter/receiver circuitry, modem circuitry, one or more unified antenna front end circuits 125, one or more wireless controller circuits such as antenna adaptation controller 134, amplifiers, antenna systems 132 and other radio frequency subsystem circuitry 130 for wireless communications via multiple radio access technologies. Each radiofrequency subsystem 130 may communicate with one or more wireless technology protocols. The radiofrequency subsystem 130 may contain individual subscriber identity module (SIM) profiles for each technology service provider and their available protocols for subscriber based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface adapter 120 to implement WLAN or WWAN modification measures as described in various embodiments of the present disclosure.

In some aspects of the present disclosure, one wireless adapter 120 may operate two or more wireless links. In a further aspect, the wireless adapter 120 may operate the two or more wireless links with a single, shared communication frequency band such as with the Wi-Fi WLAN operation or 5G LTE standard WWAN operations in an example aspect. For example, a 5 GHz wireless communication frequency band may be apportioned under the 5G standards for communication on either small cell WWAN wireless link operation or Wi-Fi WLAN operation as well as other wireless activity in LTE, WiFi, WiGig, Bluetooth, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further a wireless communication bands or operate in nearby wireless communication bands in some disclosed embodiments. Further, harmonics, user proximity, antenna orientation due to configuration, environmental wireless conditions, and other effects may impact wireless link operation when a plurality of wireless links are operating as in some of the presently described embodiments. The series of potential effects on wireless link operation precipitates a need to assess wireless device input triggers and potentially make antenna system adjustments according to the WLAN antenna adaptation control system of the present disclosure.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Wireless adapter 120 and antenna adaptation controller 134 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers which may operate in both license and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless radio frequency communication capabilities as well as licensed wireless radio frequency communication capabilities. For example, licensed wireless radio frequency communication capabilities may be available via a subscriber carrier wireless service. With the licensed wireless radio frequency communication capability, WWAN RF front end may operate on a licensed WWAN wireless radio with authorization for subscriber access to a wireless service provider on a carrier licensed frequency band.

The wireless adapter 120 can represent an add-in card, wireless network interface module that is integrated with a main board of the information handling system or integrated with another wireless network interface capability, or any combination thereof. In an embodiment the wireless adapter 120 may include one or more radio frequency subsystems 130 including transmitters and wireless controllers such as wireless module subsystems for connecting via a multitude of wireless links under a variety of protocols. In an example embodiment, an information handling system may have an antenna system transmitter 132 for 5G small cell WWAN, Wi-Fi WLAN or WiGig connectivity and one or more additional antenna system transmitters 132 for macro-cellular communication. The radio frequency subsystems 130 include wireless controllers to manage authentication, connectivity, communications, power levels for transmission, buffering, error correction, baseband processing, and other functions of the wireless adapter 120.

The radio frequency subsystems 130 of the wireless adapters may also measure various metrics relating to wireless communication pursuant to operation of an antenna optimization system as in the present disclosure. For example, the wireless controller of a radio frequency subsystem 130 may manage detecting and measuring received signal strength levels, bit error rates, signal to noise ratios, latencies, power delay profile, delay spread, and other metrics relating to signal quality and strength. Such detected and measured aspects of wireless links, such as WLAN links operating on one or more antenna systems 132, may be used by the antenna adaptation controller to adapt the antenna systems 132 according to an antenna adaptation network according to various embodiments herein. In one embodiment, a wireless controller of a wireless interface adapter 120 may manage one or more radio frequency subsystems 130. The wireless controller also manages transmission power levels which directly affect radio frequency subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a radio frequency subsystem 130, the radio frequency subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionality as described herein.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
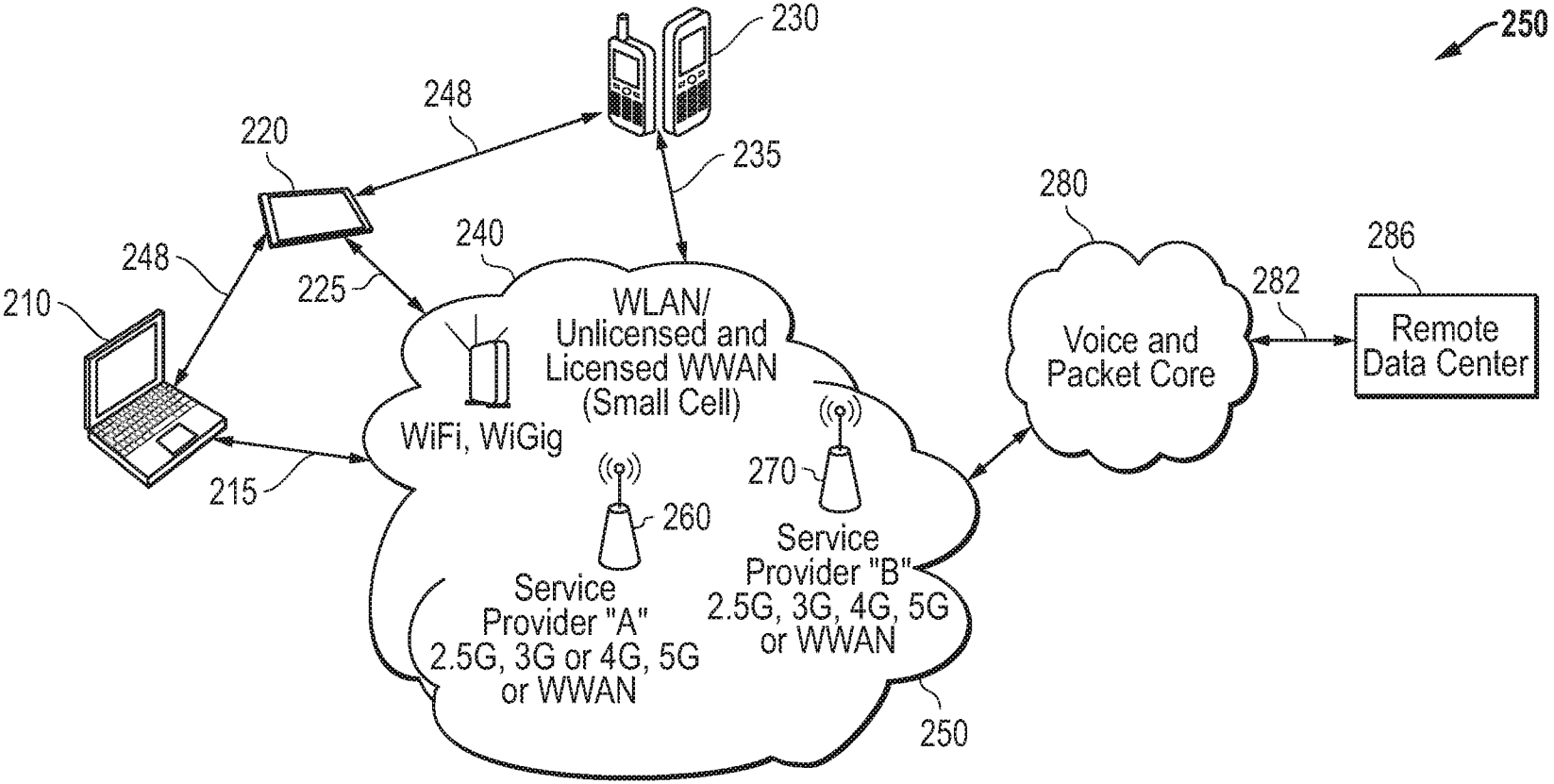
FIG. 2 is a block diagram of a network environment offering several communication protocol options and mobile information handling systems according to an embodiment of the present disclosure.

FIG. 2 illustrates a network 200 that can include one or more information handling systems. In a particular embodiment, network 200 includes networked mobile information handling systems 210, 220, and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360 degree convertible systems, wearable computing devices, or a smart phone device. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN). In an example embodiment, LTE-LAA WWAN may operate with a small-cell WWAN wireless access point option.

Since WPAN or Wi-Fi Direct Connection 248 and WWAN networks can functionally operate similar to WLANs, they may be considered as wireless local area networks (WLANs) for purposes herein. Components of a WLAN may be connected by wireline or Ethernet connections to a wider external network. For example, wireless network access points may be connected to a wireless network controller and an Ethernet switch. Wireless communications across wireless local network 240 may be via standard protocols such as IEEE 802.11 Wi-Fi, IEEE 802.11ad WiGig, IEEE 802.15 WPAN, or emerging 5G small cell WWAN communications such as eNodeB, or similar wireless network protocols. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or emerging 5G standards including WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple protocols. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Fi ISM frequency bands that could be subject to future sharing include 2.4 GHz, 60 GHz, 900 MHz or similar bands as understood by those of skill in the art. Within local portion of wireless network 250 access points for Wi-Fi or WiGig as well as small cell WWAN connectivity may be available in emerging 5G technology. This may create situations where a plurality of antenna systems are operating on a mobile information handling system 210, 220 or 230 via concurrent communication wireless links on both WLAN and WWAN and which may operate within the same, adjacent, or otherwise interfering communication frequency bands. Such issues may be addressed or mitigated with remedies according to the antenna optimization system of the unified RF front end 125 according to embodiments herein.

The voice and packet core network 280 may contain externally accessible computing resources and connect to a remote data center 286. The voice and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, another WLAN, or other network structure. Such a connection 282 may be made via a WLAN access point/Ethernet switch to the external network and be a backhaul connection. The access point may be connected to one or more wireless access points in the WLAN before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

In an example embodiment, the cloud or remote data center or networked server may run hosted applications for systems 210, 220, and 230. For example, remote data center, networked server, or some combination of both may operate some or all of an antenna optimization system including a storing and providing antenna adjustment policy to models of information handling system 100 or updates of the same as disclosed in the present disclosure. The cloud or remote data center or networked server may run hosted applications for systems 210, 220, and 230 by establishing a virtual machine application executing software to manage applications hosted at the remote data center in an example embodiment. Mobile information handling systems 210, 220, and 230 are adapted to run one or more applications locally, and to have hosted applications run in association with the local applications at remote data center or networked servers. For example, mobile information handling systems 210, 220, and 230 may operate some or all of the antenna optimization system or software applications utilizing the wireless links, including a concurrent wireless links, in some embodiments. The virtual machine application may serve one or more applications to each of mobile information handling system 210, 220, and 230. Thus, as illustrated, systems 210, 220, and 230 may be running applications locally while requesting data objects related to those applications from the remote data center via wireless network. In another example, an electronic mail client application may run locally at system 210. The electronic mail client application may be associated with a host application that represents an electronic mail server. In another example, a data storage client application such as Microsoft Sharepoint may run on system 220. It may be associated with a host application running at a remote data center that represents a Sharepoint data storage server. In a further example, a web browser application may be operating at system 230. The web browser application may request web data from a host application that represents a hosted website and associated applications running at a remote data center.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or though a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as a access point or even potentially an WWAN connection via small cell communication on licensed or unlicensed WWAN connections. For example, one of mobile information handling systems 210, 220, and 230 may serve as a Wi-Fi hotspot in an embodiment. Concurrent wireless links to information handling systems 210, 220, and 230 may be connected via any access points including other mobile information handling systems as illustrated in FIG. 2.

Figure 3:
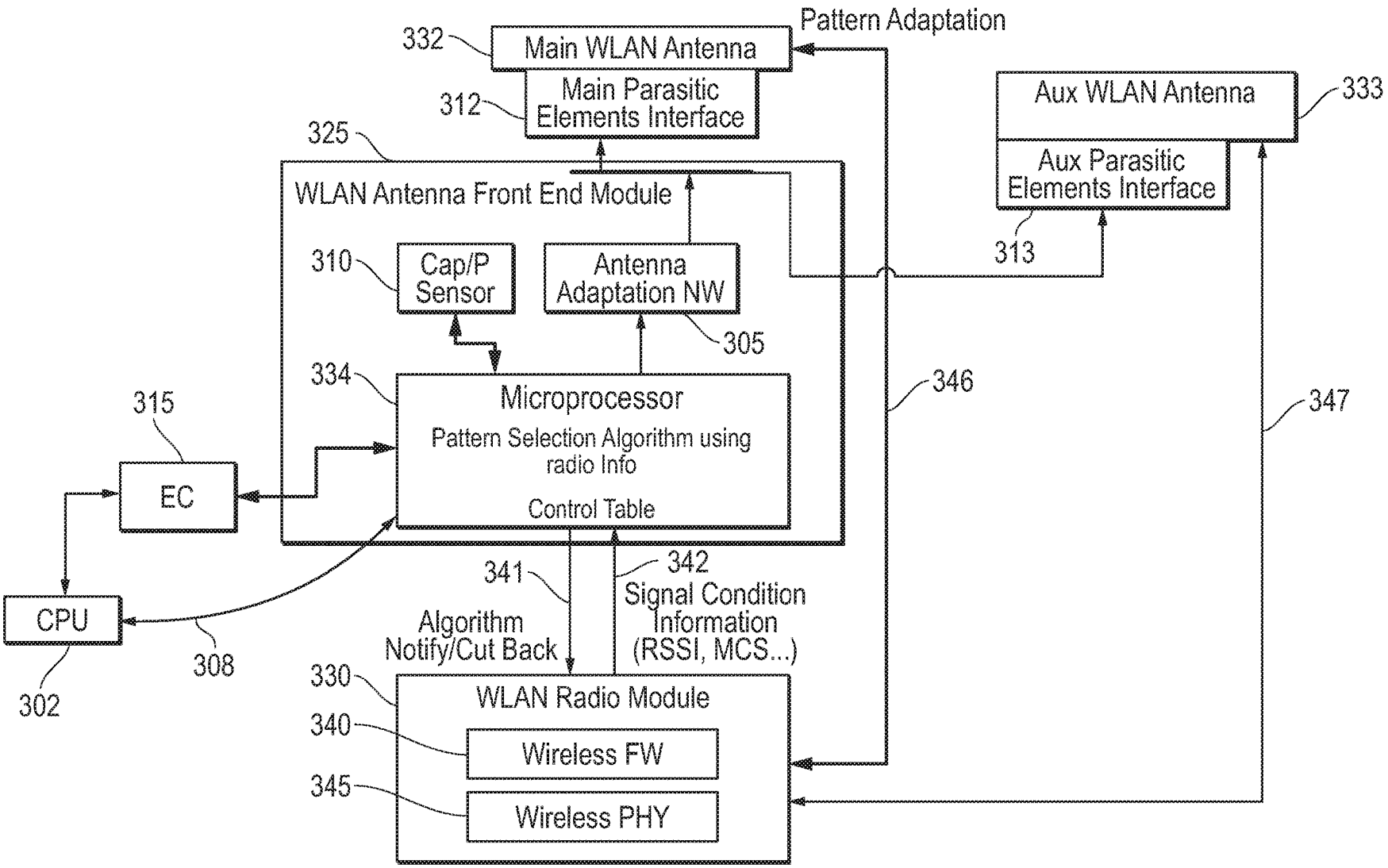
FIG. 3 block diagram illustrating an antenna adaptation controller architecture with a antenna controller front end module for an information handling system according to an embodiment of the present disclosure.

FIG. 3 illustrates a RF antenna front end 325 for one or more antenna systems that may operate on an information handling system in an example embodiment. In the embodiment shown in FIG. 3 for illustration, a WLAN antennas 332 and 333 are shown working with WLAN radio module 330, however it is understood that WWAN antenna and WWAN radio module may be used as well in other embodiments. In an example aspect, the RF antenna front end 325 may include an antenna adaptation controller 334 which may be an integrated microprocessor for antenna radiation pattern selection based on antenna trigger inputs including WLAN or WWAN radio performance inputs. In other aspects, the antenna adaptation controller 334 may be a separate microprocessor or may be integrated into another portion of a wireless adapter such as that shown herein for an information handling system. For example, in some aspects, the antenna adaptation controller 334 may be integrated into one or more wireless radio modules such as the WLAN module 330. In yet other aspects, some or all of the operations of the antenna adaptation controller 334 may be distributed across microprocessing capabilities embedded within several portions of the wireless adapter of an information handling system. In this way, the operation of the antenna adaptation controller 334 may be operating system independent when optimizing a WLAN or WWAN antenna configuration. The antenna adaptation controller 334 may work to determine a WLAN or WWAN antenna configuration, including antenna RF patterns, to be used when radiofrequency conditions change such as with a physical reconfiguration of the information handling system or a detection of a user proximate to an antenna system with minimal requirements on the operating system and CPU except perhaps responses to queries for antenna trigger input data.

The RF antenna front end 325 may further operate a capacitive or other proximity sensor via a control circuit 310. Capacitive or other proximity sensor data received by 310 and provided to the antenna adaptation controller 334 may serve as an example antenna trigger for which consideration of antenna performance is assessed when determining steering or switching to a second, auxiliary antenna to maintain WLAN or WWAN connectivity quality levels or exposure level limits. The capacitive or other proximity sensing system 310 may detect a user touching or otherwise nearby a sensor located on the information handling system. A detected change in capacitance or other proximity indication may be sent back to the capacitive or other proximity sensing system 310 to indicate that a user may be within a distance range of a transmitter or transceiving antenna system such that specific absorption rate (SAR) safety standards require a reduction in transmission power to avoid exposure levels of RF radiated energy to a user of the information handling system. It is understood that a proximity sensor may be any of a variety of types including capacitive, infrared, touch screen, visual light, infrared, or other sensor to detect the proximity of a user to an information handling system. Additionally, in various embodiments, the proximity sensor may be located anywhere on the information handling system. In some particular embodiments, a proximity sensor may be located adjacent to or otherwise nearby to one or more antenna systems, such as main WLAN antenna 332 or auxiliary WLAN antenna 333 or similarly to WWAN antennas, on the information handling system.

In some embodiments, antenna systems such as main WLAN antenna 332, may include a parasitic elements interface 312 which may permit control over the antenna radiation pattern of the main WLAN antenna 332. Similarly, other antenna systems such as auxiliary antenna 333 may also have an auxiliary parasitic elements interface 313 providing for control over the antenna radiation pattern of the auxiliary WLAN antenna 333. Similar parasitic element interfaces may be used to control radiation patterns for WWAN antennas as applicable. An antenna adaptation network 305, controlled by the antenna adaptation controller 334, may provide for control over phase shifting the coupling currents to one or more parasitic elements of either the main WLAN antenna 332 or the auxiliary WLAN antenna 333. Activation of increased phase shift to a parasitic element of the main WLAN antenna 332 or the auxiliary WLAN antenna 333 or decreased phase shift other parasitic elements or the primary antenna aperture or other transmitting device may be used to steer an antenna transmission pattern by the WLAN front end module 325 operating an antenna adaptation controller 334 in various embodiments. For example, the main WLAN antenna 332 or the auxiliary WLAN antenna 333 may be embedded in a metal chassis such as a display screen housing for an information handling system. Some or all of a metallic chassis, hinge, bezel, or other structural component of the information handling system may act as a parasitic element for interface via 312 or 313, providing RF radiation with phase shift for transceiving WLAN signals. The main parasitic elements interface 312 and auxiliary parasitic elements interface 313 may be used by the antenna adaptation network 305 to direct phase shift such that these parasitic elements may influence the current thereby steering the shape of the RF antenna pattern for either the main WLAN antenna 332, the auxiliary WLAN antenna 333, or both. It is understood that any number of WLAN antennas may be deployed with the WLAN front end module 325 or by the information handling system in other embodiments although the present embodiment describes two WLAN antenna systems. Similarly, it is understood that the above discussion may be applied to WWAN antennas in other embodiments.

In an example embodiment of antenna steering control implemented via the antenna adaptation controller 334 via an antenna adaptation network 305, impedance or capacitance tuning may be executed to adjust the ratio of impedance to capacitive reactance for one or more antenna systems to adjust phase shift of RF current coupling to influence directivity patterns for main WLAN antenna 332, the auxiliary WLAN antenna 333, or any other WLAN or WWAN antenna systems deployed in an information handling system. In an example embodiment, a variable capacitor may be used to alter the ratio of impedance to capacitive reactance. For example, a WiFi 2.4 or 5 GHz transmitting antenna operating several parasitic antenna elements may decrease rejection between main and auxiliary WLAN antennas or aperture 332 and 333. This may occur, for example, through antenna radiated pattern coupling paths through main and auxiliary parasitic elements interface 312 and 313 to alter the antenna pattern or direction of the WiFi 2.4 or 5 GHz transmitter antenna system. The antenna adaptation network 305 of the present embodiment may implement pattern decorrelation by finding the radiation pattern pair between the main and auxiliary antenna ports with orthogonal directivity that enhances the RSSI, SNR or other signal quality indication using the firmware or other algorithms of the antenna adaptation controller 334 as described in embodiments herein. By using a parasitic coupling element with a variable impedance termination and which may be triggered by a switch, the system may control the directionality of the transmission signal to thereby causing a shift of transmission pattern. The antenna adaptation controller 334 may control this aperture tuning for the antenna ports for both the main WLAN antenna 332 or the auxiliary WLAN antenna 333 to alter RF transmission pattern potentially improve RSSI, SNR, MCS or other performance factors.

In yet another example embodiment of coexistence control implemented via the unified RF antenna front end, by altering or cancelling out the antenna port to port coupling between antenna ports, this may enhance rejection between ports of the plurality of antenna systems concurrently operating. For example during concurrent operation, such as a hotspot, a WiFi 5 GHz transmitting antenna operating concurrently with co-located LTE LAA receiving antenna could desense LTE LAA receiver through port to port coupling as well. A unified RF antenna front end of the present embodiment may have a tunable decoupling network comprising a transmission line at the input of each antenna port to convert the trans-admittance between ports to purely a reactance. This, followed by a tunable reactive component in shunt between the transmission lines to cancel out the reactance between the concurrent antenna ports may create an open circuit (OL) at the frequency of operation. This control may result in an improved rejection of interference between the antenna ports.

Additionally, RF pattern shape control may be implemented in some embodiments by tuning for advanced open loop using feedback (AOL) or closed loop using power detection (CL) circuit. Antenna port termination or tuning may be altered to enhance transmission pattern diversity. In another aspect, one of the antenna port terminations or tuning may be altered to increase reflection to increase interference rejection for one or other portions of the WLAN antenna aperture or parasitic elements. Further the OL, AOL and CL may be tuned at an antenna port termination to reduce output power to meet SAR body exposure limitations. An antenna adaptation network may use a tunable capacitor integrated circuit to alter the antenna port termination and tune in response to antenna triggers processed by the antenna adaptation controller 334 such as from a proximity sensor, capacitive sensor, accelerometer, gyroscope or other motion or orientation sensors detecting physical configuration or a user proximate to one or more antenna systems 332 or 333. The antenna adaptation controller 334 may use to antenna trigger feedback data to conduct the advanced open loop (AOL) tuning operations in aspects of the embodiment herein.

In another example embodiment of RF shape pattern control, phase shift using aperture tuning may shift the antenna's directivity in that radiofrequency radiation may be directed to occur at a greater proportion on the primary antenna aperture or at a greater level on one or more parasitic elements such as the antenna system board, traces, or chassis of the information handling system which may participate in radio frequency transmission and reception. Radiation pattern may be coupled into system board, traces which may introduce or increase noise floor which may impact the RSSI, SNR, MCS or other signal quality indications. Degradation of the RSSI or other metrics detected by the antenna adaptation controller 334 will be used to move antenna pattern directivity away from the system board to enhance RSSI and other link performance metrics thereby achieving a closed loop power control and pattern adaptation.

In yet another example embodiment of RF shape pattern control, selection of open circuit, advanced open circuit, or a closed loop may be implemented or activated by the antenna adaptation controller 334 to alter RF transmission shape patterns. Referring to AOL (Advance open loop using feedback) or CL (Closed loop using RSSI and other metrics detected form a wireless adapter) tuning, either antenna port termination or tuning may be altered to improve or enhance pattern diversity or to increase reflection to increase rejection and decrease output power to meet SAR exposure limits. An antenna adaptation network 305 may use a tunable capacitor integrated circuit, in conjunction with a parasitic element, to alter the antenna port termination, tuning, phase shift, or any combination based on the control from the antenna adaptation controller 334 in response to antenna trigger data. For example, the antenna adaptation controller 334 may thereby conduct advanced open loop tuning using feedback from P-Sensor or other sensor inputs to change pattern directivity or antenna tuning using impedance and aperture tuning techniques.

The WLAN or WWAN antenna RF shape pattern adjustments may include modification of only one antenna, or any or all antennas in operation according to embodiments described herein. Examples of antenna configuration modifications that may be implemented as RF shape pattern control antenna aperture tuning at the antenna ports with varying impedance terminations to alter the phase shift of coupling currents and directionality of a particular antenna system, or decoupling networks activated between WLAN antenna ports operating concurrently to enhance rejection of signals between the ports. Combination of the RF shape pattern controls may be utilized including these examples or any combination by an antenna adaptation network 305 in connection with the antenna adaptation controller 334 and WLAN radio module 330 or WWAN radio module. Further, additional antenna control measures may be employed including turning off or turning down power to some antenna systems and using alternative options such as between parallel wireless links from a MIMO set of wireless links with several parallel data streams on wireless connections.

Thus, the antenna adaptation network 305 in connection with the antenna adaptation controller 334 may make antenna configuration adjustments by altering phase shift via variable impedance termination achieved through impedance or aperture tuning to affect antenna directionality pattern. Alteration of antenna directionality pattern may shift radio frequency radiation more to an antenna or to other radiating elements such as a chassis, board or other elements depending on the ratio of antenna impedance to capacitance. This may direct radio frequency transmission energy to or away from the primary antenna apertures, chassis, or other parasitic portions used by the antenna systems 332 and 333.

Antenna adaptation controller 334 further may communicate with a variety of additional antenna trigger data sources. For example, the antenna adaptation controller 334 may be connected to receive usage mode physical configuration data from an embedded controller (EC) 315. EC 315 may detect the orientation and configuration of an information handling system and the relative position and orientation of the one or more antenna systems, such as 332 and 333, relative to the physical configuration of the information handling system. EC 315 may work in connection with a sensor hub connected to various motion sensors, orientation sensors, and position sensors to detect the relative physical configuration and orientation of portions of the information handling system relative to other portions of the configurable information handling system. Example sensors may include accelerometers, digital gyroscopes, hinge angle detectors, and other orientation sensors. The orientation sensors may be coordinated with the EC 315 such as via the CPU 302. CPU 302 may also be operatively coupled to WLAN antenna front end module 325 in a wireless adapter of the information handling system via a bus 308 to permit communication of data wirelessly transceived via the WLAN antenna front end module 325 and WLAN radio module 330.

Orientation sensors may provide sensor data that serves as all or part of some of the inputs to EC 315 described. EC 315 may gather sets of data from some or all of a variety of orientation sensors, proximity sensors, docking sensors or the like as shown for use with a variety of usage modes for various physical configurations. A sensor hub may be located within wireless interface adapter or elsewhere on the motherboard of the information handling system (not shown). Orientation sensor types include motion sensors and other sensors including one or more digital gyroscopes, accelerometers, and magnetometers. Motion sensors may also include reference point sensors. For example, a geomagnetic field sensor may determine position of a display screen relative to a keyboard of a laptop or a 360 degree convertible device. This positional information may provide x-axis, y-axis, and z-axis positional information of the information handling system relative to magnetic north pole, and there for a reference point of the device position. In one embodiment, two geomagnetic field sensors provide x-axis, y-axis, and z-axis positional information for a keyboard and display screen or for each display screen housing of a dual display housing information handling system according to various embodiments herein. With sensor data from any of several combinations of the above sensors, the system determines the relative position of the two housings to one another in orientation, such as two display screen housings or a display screen and keyboard housing.

Also, a digital gyro and accelerometer may be used to detect motion and changes in position. These sensors may provide a matrix of data. In an example embodiment, the azimuth or yaw, pitch, and roll values of the device are indicated by the raw sensor data. The orientation data may be relevant to relative locations of antennas with an information handling system such as those located in different hinged portions in one embodiment. In connection with a reference point, such magnetic north as provided in one embodiment by a geomagnetic field sensor, the azimuth can be determined as a degree of rotation around a z-axis. Further hinge azimuth angle may be discussed further below. In an embodiment, the azimuth may be the value of the z-axis relative to the device y-axis as positive angle values between 0° and 360°. It is understood that a different range of values may be assigned in different embodiments of a laptop, 360 degree convertible device, or even a tablet computing system which may have a plurality of display screens or a single, foldable display screen across two housings.

Based on a reference point such as provided by a geomagnetic field sensor, pitch may be determined as a degree of rotation around the x axis. In an example embodiment, the angle values may range from positive 180° to negative 180° relative to the y-axis, although other value ranges may be assigned instead. Roll is also based on the reference value, for example that established by a geomagnetic sensor. Roll may be considered to be rotation about the y-axis and its values may range from positive 90° to negative 90°. Again, the value ranges assigned can vary for each of the azimuth, pitch, and roll as long as a set of values is used to define orientation parameters in three dimensional space.

The orientation sensor data may be processed partly by a sensor hub or accumulator, which may be EC 315, to provide orientation data for the information handling system. The sensor hub performs a fusion of data signals received from either a single sensor or multiple sensor devices. In one example embodiment, the sensor hub is an independent microcontroller such as the STMicro Sensor Fusion MCU.

The sensor data may further include proximity sensors or capacitive touch sensors. For example, touch or hover sensors may detect when a screen is actively being used. Further, proximity sensors, for example capacitive sensors, may detect the location of a user relative to various parts of the information handling system and antennas located nearby such for the proximity sensor system 310 above. Proximity sensors on one or more display screens or a keyboard may detect the position of a user body part such as a hand, lap, arm, torso or the like) around information handling system (for example, directly in front, above, below, to the right, or to the left of the plane of the display screen or the keyboard) and thus determine required SAR levels based on the position of the user or users.

Another sensor state of usage activity sensor is a Hall Effect sensor that may detect when a magnet, of certain polarity and strength, is in proximity to the sensor. It is used to detect the closed position of a device with two sides. For example, a Hall Effect sensor may determine when two hinged display screens or a screen and keyboard are closed onto one another so that a magnet in one screen triggers a Hall Effect sensor in the second screen. Alternatively, a different Hall Effect sensor may determine if the hinged display screens are open to an orientation of 360° so that the back sides of the display screens are in proximity such that a magnet located with one display screen triggers the Hall Effect sensor of the other.

Hall Effect magnets and magnetic sensors may be deployed as a type of orientation or state sensor for usage mode trigger inputs. It is known in the art that a relative angle between a magnetic field source of known polarity and strength may be determined by strength and change to a magnetization vector detected by magneto-resistive detectors of a Hall Effect sensor. Thus, motion and relative angle may also be detected by the Hall Effect sensors. The Hall Effect sensor may also detect when a 360 degree convertible laptop computer is fully open or closed.

Other detectors are also contemplated include a docking station connection detector to detect when a mobile information handling system has been docked and is likely used in a desktop format. Additional other detectors may include a hinge angle detector that may be mechanical, electromechanical or another detecting method to determine how far the hinge between the two display screens has been opened. Such detectors are known in the art. Yet other detectors are also contemplated such as a hinge angle detector that may be mechanical, electromechanical or another detecting method to determine how far the hinge between the two display screens has been opened. Such detectors are known in the art.

In an example embodiment, the information handling system may be a convertible laptop which may be operated in a plurality of usage mode configurations. The convertible laptop may include a plurality of housings connected by a hinge which may be oriented in a variety of ways with respect to one another or in space relative to a user. EC 315 may be used to detect a usage mode for a physical configuration of the convertible laptop in an example embodiment. For example, a laptop usage mode may include a display in one housing and a keyboard in another housing. Physical configurations may include a laptop mode whereby the display is viewable above the keyboard in a traditional laptop configuration in one example embodiment. In another physical configuration embodiment, the display may be folded around to lay flat and adjacent to the housing of the keyboard such that a laptop physical configuration may be detected for the display housing relative to the keyboard housing. Additionally, the physical usage mode configuration of the convertible laptop information handling system may also have impact on the orientation and location of antennas and antenna transmission patterns for the one or more WLAN antennas 332 and 333 or any WWAN antennas. In an example embodiment, an EC 315 may detect laptop mode physical configuration and assign a value of 1 while a detected tablet mode may be assigned a configuration value of 0. It is understood that any value may be assigned such that EC 315 may indicate laptop mode and tablet mode in example embodiments.

In another example embodiment, the information handling system may be a foldable dual screen display information handling system or an information handling system having a foldable LCD or OLED display which may be folded or bent over two housings. Such an information handling system with two displays or a single bendable display over two housings may include two display areas or one virtual display area in some embodiments. In an aspect, a virtual keyboard may be displayed on either display screen or a portion of a display screen on either housing. Such a foldable tablet information handling system may have a plurality of configurations including a tablet configuration, a dual tablet configuration, a laptop configuration, a tent mode configuration, a book configuration, as well as several other configurations. The orientation sensors may detect physical configuration in accordance with embodiments herein including relative location and orientation of housings relative to one another for each of tablet configuration, a dual tablet configuration, a laptop configuration, a tent mode configuration, a book mode configuration, as well as other configurations and relative orientation and location of WLAN antenna systems such as 332 and 333 as well as their antenna transmission patterns for RF radiation during wireless communications. In another example embodiment, an EC 315 may detect usage mode physical configuration and assign values for each of tablet configuration, a dual tablet configuration, a laptop configuration, a tent mode configuration, a book mode configuration, as well as other configurations.

EC 315 may be connected to WLAN antenna adaptation controller 334 via a data bus for reporting physical configuration data for various usage modes detected. In one example embodiment, WLAN antenna adaptation controller 334 may maintain a master-slave relationship with antenna trigger input data sources. WLAN antenna adaptation controller 334 may poll antenna trigger input data from the capacitive/proximity sensor system 310, the EC 315 for configuration data, and WLAN signal condition data along 342 from WLAN radio module 330. For example, the data lines connecting to WLAN antenna adaptation controller 334 may be I2C data lines. In a further example, the I2C data lines may be pulled high when the master WLAN antenna adaptation controller 334 is not polling for data and configured for I2C bus communication when the antenna adaptation controller 334 queries a slave antenna trigger data device for antenna trigger data information. The antenna trigger data providers may respond to polling queries from the antenna adaptation controller 334 with reports related to measurements or status determinations. Further, antenna trigger data provider slave devices such as the proximity sensor system 310, EC 315, WLAN radio module 330, RFICs in the wireless adapter, or other antenna trigger data providers may also obtain attention of the antenna adaptation controller 334 via GPIO interrupt operation along the same or different communication lines in some embodiments. Upon an event, an interrupt signal to the antenna adaptation controller 334 may cause the antenna adaptation controller 334 to configure the data lines to operate as an I2C communication line and query the slave antenna trigger data device to provide the event information.

In one example embodiment, an I2C line may be used as communication line 342 to report WLAN signal condition data such as received signal strength (RSSI), signal to noise ratio (SNR), modulation coding scheme index (MCS), bit error rates (BER), transmission power levels, reception power levels, TX/RX status, data packet volumes and other data reported by the WLAN radio module 330 or WWAN radio to the antenna adaptation controller 334. Further, the antenna adaptation controller 334 or other aspects of the WLAN or WWAN antenna front end module 325 may provide notification of operations to switch between the main WLAN antenna 332 and auxiliary WLAN antenna 333 (or WWAN antennas) or to provide power cutback requirements to WLAN radio module 330 or WWAN radio depending on the antenna trigger inputs received by the antenna adaptation controller 334. Control or notification data from the antenna adaptation controller 334 or WLAN antenna front end module 325 or a WWAN antenna front end may be transmitted along communication line 341. Detection of WLAN or WWAN signal conditions and receipt of control or notification commands or data from the antenna adaptation controller 334 may be processed by the WLAN or WWAN radio module in the firmware layer 340 and may be executed in the physical layer 345.

WLAN radio module 330 may command power levels or data operations with the main WLAN antenna system 332 via RF line 346 or with auxiliary WLAN antenna system 333 via RF line 347.

In yet another aspect, RF antenna front end 325 also may accommodate SAR safety requirements while selecting an optimal WLAN or WWAN antenna configuration among the plural antenna systems operating concurrently on the information handling system. Concurrent antenna operation may be with MIMO or other aggregation connectivity through plural WLAN or WWAN antennas on the information handling system. Adjustments for improved WLAN or WWAN antenna performance between concurrently operating WLAN or WWAN antennas may also yield load shifting among the multiple wireless data streams to enhance utilization of WLAN or WWAN signals with the best radio conditions and performance.

The RF antenna front end 325 may include a WLAN antenna adaptation controller 334 or other microcontroller that may include access to a local memory (not shown). The RF antenna front end controller 325 may also interface with one or more tuners for interfacing directly or via a tuner systems with a plurality of antenna systems such as main WLAN antenna 332 and auxiliary WLAN antenna 333 or similar WWAN antennas. In various example embodiments, any plurality of Wi-Fi antennas may be mounted and operational on the information handling system in which RF front end 325 is installed and which may operate similarly with one or more antenna adaptation controllers 334.

Antenna systems, such as main WLAN antenna 332 and auxiliary WLAN antenna 333 or similar WWAN antennas, may be a variety of antenna systems that are mounted within the information handling system or may utilize peripheral antenna systems connected to RF antenna front end 325. In some example embodiments, antenna systems 332 and 333 may utilize an antenna device installed on an information handling system with a primary dipole radiator or antenna aperture for each of 332 and 333. In other embodiments, antenna systems 332 and 333 may also incorporate RF radiator surfaces such as portions of the information handling system chassis, motherboard, wiring/traces, or case components as aspects of the antenna systems 332 and 333. Some of these RF radiation effects may not be intentional. In yet other example embodiments, antenna systems 332 and 333 may utilize auxiliary devices such as cords or cabling external to the information handling system.

RF antenna front end 325 and WLAN antenna adaptation controller 334 may be connected to a plurality of system motherboard components of a wireless interface device for a mobile information handling system including the EC 315, the proximity sensor system 310, the WLAN or WWAN radio module 330 among others. For example, I2C lines such as 341 and other shown connections may be connected between the RF antenna front end 325, including the antenna adaptation controller 334, and a WLAN or WWAN radio module 330. In a further aspect, a Mobile Industry Processor Interface (MIPI) connectors may be connected via one or more MIPI lines to antenna adaptation controller 334 in other embodiments. The I2C bus or MIPI connector may be used to forward instructions, policy details, or other data or commands to and from the antenna adaptation controller 334 according to embodiments of the present disclosure. It is understood that the I2C lines or MIPI lines may be used for various aspects of the embodiments disclosed herein including for transfer of data, antenna trigger inputs, policy, or commands from antenna adaptation controller 334 or other subsystems of the wireless interface device adapter to the RF antenna front end 325 and WLAN or WWAN radio module 325 in various aspects of the embodiments of the present disclosure.

The antenna adaptation controller 334 of the wireless interface adapter may access antenna trigger inputs received from sensor hub 315 and WLAN or WWAN radio module 330 reporting WLAN or WWAN signal condition feedback for antenna configurations of 332 and 333 according to various embodiments of the present disclosure determine one or more appropriate antenna configuration modifications, if any, based on antenna trigger data received. Various embodiments of the wireless interface adapter shown in FIG. 3 are contemplated.

Figure 4:
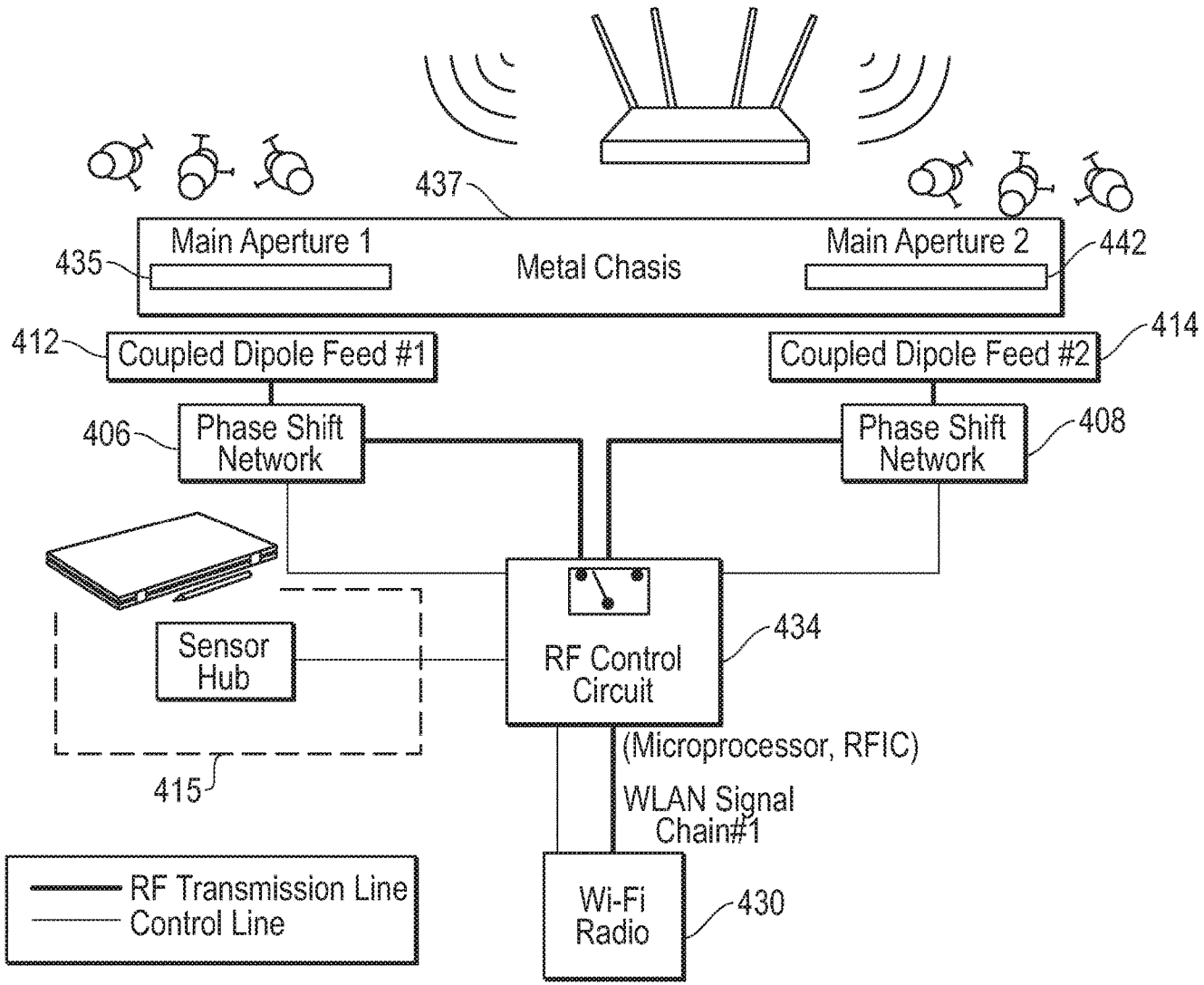
FIG. 4 block diagram illustrating an antenna adaptation controller architecture with a radio frequency front end module for an information handling system according to another embodiment of the present disclosure.

FIG. 4 illustrates an antenna adaptation controller 434 or other aspects of the WLAN antenna front end module including a sensor hub 415 and WIFI radio module 430 according to another embodiment of the present disclosure. In other embodiments another type of WLAN radio module or WWAN radio module may be used, however for purposes of illustration a WLAN system is described in the example of FIG. 4, It is understood that the system of FIG. 4 may be similarly adapted to operate with a WWAN radio module. Similar to that shown in FIG. 3, FIG. 4 illustrates the antenna adaptation controller 434 which may be part of a WLAN RF front end. WLAN antenna adaptation controller 434 may be an independent microprocessor executing firmware and hardware instructions or may be integrated with other RFIC circuits within the wireless adapter of an information handling system. The antenna adaptation controller 434 may control switching between the WiFi radio module 430 and a plurality of antennas. Both control lines and transmission lines may connect the WiFi radio module 430 with the antenna adaptation controller 434 in the embodiment shown in FIG. 4. Further, WLAN antenna adaptation controller 434 may also have a transmission line and control line to a phase shift network 406 for a coupled dipole feed #1 412 as well as a transmission line and control line to a phase shift network 408 for a coupled dipole feed #1 414 as in the shown embodiment.

The coupled dipole feed #1 412 may be connected for transmission to a main antenna aperture 1 435 in a metal chassis 437. The phase shift network 406 may alter the steering of the antenna transmission pattern for the main antenna aperture 1 435 depending on desired results due to antenna trigger inputs received by the antenna adaptation controller 434. Example differences in antenna radiation patterns are shown above main antenna aperture 1 435 which are merely exemplary for explanation purposes.

The coupled dipole feed #2 414 may be connected for transmission to a main antenna aperture 2 442 in a metal chassis 437. The phase shift network 408 similarly may alter the steering of the antenna transmission pattern for the main antenna aperture 2 442 depending on desired results due to antenna trigger inputs received by the antenna adaptation controller 434. Example differences in antenna radiation patterns are also shown above main antenna aperture 2 442 for explanation purposes only.

Sensor hub 415 may operate similarly to the operation of the embedded controller described above to determine orientation of the information handling system to determine a physical configuration of multiple housings of the information handling system relative to one another and the outside environment. For example, the sensor hub 415 may determine a usage mode physical configuration such as a laptop mode, tablet mode or other mode for a convertible laptop device or for an information handling system having plural display housings for multiple displays or a single bendable display across both housings. The usage mode physical configuration determined by sensor hub 415 may be used to estimate the location or direction of the antenna apertures 435 and 442 within a metal chassis 437 of the information handling system. Thus, an alteration in the physical configuration may be received as an antenna trigger input by the antenna adaptation controller 434 to switch radiation patterns of the antenna apertures 435 and 442 or to switch between antenna apertures depending on other antenna trigger inputs such as WLAN signal performance feedback received from the WiFi radio 430.

A phase shift network 406 or 408 operates to steer the antenna radiation pattern to additional radiation pattern options while compensating for detuning effects of altering the coupling when steering the RF antenna pattern. The phase shift network may operate to alter RF current distribution for a coupled antenna aperture and any parasitic elements through coupling alterations with various antenna elements. This may steer the antenna RF transmission pattern, but may also accommodate phase matching for the RF current distribution adjustments to accommodate any potential detuning of the use of the antenna aperture 435 or 442.

In an aspect, the antenna adaptation controller 434 may operate along with the RFIC and other front end components to provide for switching of RF transmission signals. For example, WLAN antenna adaptation controller 434 may operate control circuitry to switch between antenna apertures 435 and 442 in some embodiments. In other embodiments, the antenna adaptation controller 434 may operate control circuitry to modify data flow loads between antenna apertures 435 and 442 in other embodiments such as those utilizing plural antennas 435 and 442 for aggregated MIMO operations. As described for FIG. 3, several variation are contemplated for the arrangement of WLAN antenna adaptation controller 434 and control circuitry over antenna apertures 435 and 442 in various embodiments, including connectivity to sensor data 415 and WLAN radio performance data from 430 as well as other antenna trigger inputs.

Figure 5:
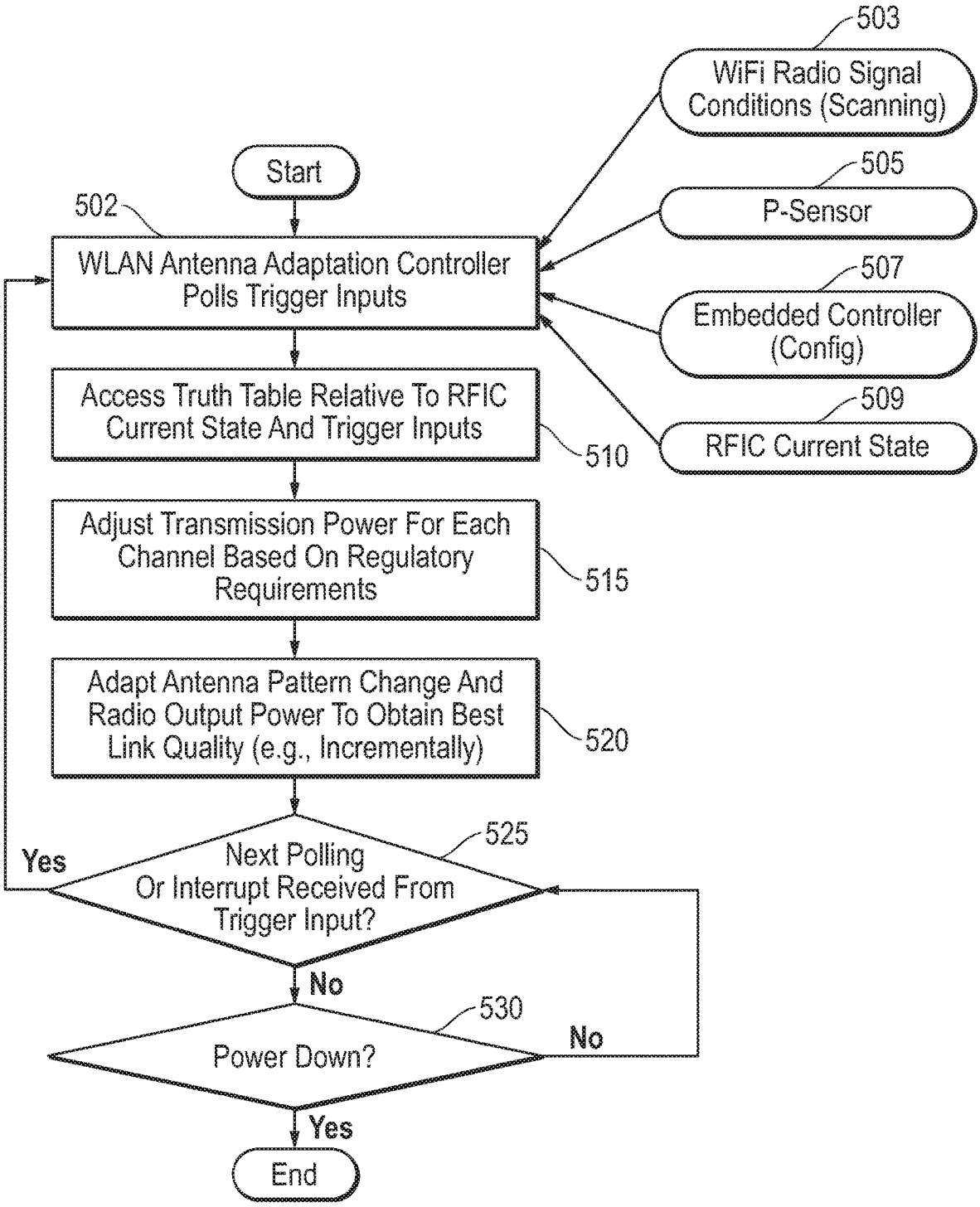
FIG. 5 is a flow diagram illustrating a method of operating an antenna adaptation controller with antenna trigger data polling according to an embodiment of the present disclosure.

FIG. 5 illustrates a method for determining antenna adjustments or modification to optimize operation WLAN antenna systems via operation of an antenna adaptation controller according to an embodiment. In this example embodiment, one or more wireless antenna systems may be available to a user mobile information handling system as described above. In particular, the information handling system may have a wireless adapter for communication via a WLAN radio module and access to a plurality of available WLAN antennas. In some embodiments, the WLAN system may utilize a 1×1, 2×2, or N×N WLAN MIMO operation. The antenna adaptation controller may select among a plurality of available WLAN antennas which may further utilize WLAN signal condition feedback to determine power adjustments, transmission/reception data flow among available WLAN antenna systems, and adjustments to antenna radiation patterns. In embodiments, the antenna adaptation controller may provide for improved WLAN MIMO operation to maintain optimal throughput or WLAN signal conditions while taking into account changes in physical configuration of the antennas relative to the information handling system when usage modes change as well as accounting for required power reductions due to SAR safety requirements for RF exposure to users proximate to the antennas.

The method of FIG. 5 may be executed via firmware instructions or hardwired instructions for an antenna adaptation controller which may be a single controller or distributed among an RF front end, WLAN or WWAN radio module, RFIC, or other portions of a wireless adapter in an information handling system. It is understood that each of the following steps may be performed by the antenna adaptation controller with antenna trigger input data detected and received from other portions of the mobile information handling system including other portions of the wireless adapter. Some or all of the steps however may be performed in a distributed antenna adaptation controller across several portions of the wireless adapter in some embodiments. The steps of FIG. 5 may be applied to WWAN or WLAN radio systems as understood although WLAN is referred to in the figure. Changes to antenna radiation patterns may be made via control lines to the antenna adaptation network to modify parasitic elements interface to change phase shift of coupled current distribution between parasitic elements and main radiators of an antenna to steer a radiation pattern as described with various embodiments herein. Further, the antenna adaptation controller may control data flow for transmission among a plurality of WLAN or WWAN antenna systems or may instruct a WLAN or WWAN radio module to switch between available antennas or allocate ratios of data to be transmitted MIMO based on conditions detected by the antenna adaptation controller.

At 502, the antenna adaptation controller may poll various antenna trigger inputs via a control and data lines with those systems. Each of the WiFi or WWAN radio module for signal condition data 503, the proximity sensor 505, the embedded controller 507, and the RFIC for the wireless adapter reporting wireless antenna state information 509 may operate as antenna trigger data system providers. Each antenna trigger data system provider 503, 505, 507, or 509 may be connected to the antenna adaptation controller via clock and data lines for communication of polling requests and antenna trigger data information in return. Any request/exchange paradigm may be established in other embodiments. In one embodiment, the antenna adaptation controller may be connected via I2C clock and data lines whereby the antenna trigger data system providers may operate in a master/slave bus mode to await a polling request from the antenna adaptation controller acting as a master device. The I2C clock/data lines may be pulled high, such as with open drain signals, when the antenna adaptation controller is inactive and not polling the I2C lines. Upon receiving a low signal on the I2C bus indicates a request for data which may include the query for data which the antenna trigger data system providers respond to with information about WLAN or WWAN radio conditions 503, proximity sensing 505, usage mode physical configuration 507, or antenna operation state data 509.

In addition, when an event occurs at an antenna trigger data system provider requiring an update be sent to the antenna adaptation controller, an antenna trigger data system provider may signal the master antenna adaptation controller. The communication and data lines may also be arranged to operate as an interruptible GPIO to indicate a slave antenna trigger data system has an event to report. The interrupt signal may be provided by a GPIO signal pulse. In an example embodiment, an interrupt pulse of 10-100 microseconds may be used. In response, the antenna adaptation controller may reconfigure to an I2C bus mode and send a query to the notifying slave antenna trigger data system provider for the event data. The notifying slave antenna trigger data system provider may respond to the query by sending the event information. Polling may take place on the I2C bus from the antenna adaptation controller on a periodic basis in some embodiments. In other embodiments, the GPIO interrupt operation capabilities are maintained when the I2C bus is idle to allow for slave antenna trigger data system providers to notify the antenna adaptation controller of event occurrences. In various embodiments, polling by the antenna adaptation controller may occur periodically or in response to a GPIO interrupt signal or by other data exchange paradigms understood in the art.

The antenna adaptation controller may poll for WiFi radio signal conditions 503 and initiate scanning of WLAN or WWAN conditions for RSSI, SNR, MCS, TX/RX status and power levels, data throughput, and other metrics gathered and stored by a WLAN radio module, RFIC, or other components in the wireless adapter. Polling for and scanning for radio conditions from a WLAN radio module at 503 will provide for current conditions of radio operation on all available WLAN or WWAN antennas for the information handling system. A threshold level of RSSI, MCS, data throughput or other metric will be established as a target level for minimum satisfactory operation of the WLAN or WWAN system. This threshold level will depend on the capabilities of the WLAN or WWAN radio module and the one or more WLAN or WWAN antennas available for operation. The threshold level of satisfactory operation may be a percentage level of maximum RSSI, SNR, MCS, or throughput available under ideal operating conditions in some embodiments. For example, a threshold requirement may be set 50% of rated available operation levels before an MCS reduction to a next lower level is triggered by the WLAN radio in some embodiments. So for a WLAN link on one embodiment, an RSSI of −51 dBm under optimal conditions may use a level of −54 dBm as a threshold level of permissible WLAN radio signal operation, for example at MCS9, 256 QAM, code rate 5/6 delivering a throughput of 390 Mbps for an 80 MHz bandwidth. Crossing this threshold For a WLAN link, such as a MIMO WLAN operation, in another embodiment, data throughput capabilities or MCS data rate of 390 Mbps may be available under optimal conditions. In such an embodiment, a level of 351 Mbps may be selected as a threshold level of permissible operation. It is understood that any percentage may be set as a threshold level of operation for any or all of the WLAN radio and antenna systems. Several performance metrics may also be used for the WLAN or WWAN performance metric and threshold including a matrix of several performance metrics such as RSSI, SNR, MCS, data throughput or the like.

The antenna adaptation controller may also poll to receive RFIC current state data 509. RFIC state data 509 may indicate activity of WLAN or WWAN antennas as well as operating state such as whether MIMO operation is in effect in some embodiments. In other aspects, RFIC state data 509 may include power levels allocated for transmission on the plurality of available WLAN or WWAN antennas, the state of current transmission steering including power allocations or other aspects to configure parasitic elements within each antenna system relative to main antenna apertures, or the status of phase shift operation for coupling to the WLAN or WWAN antenna apertures.

The antenna adaptation controller may further poll trigger inputs from an embedded controller 507 including configuration data indicating what usage mode physical configuration is currently detected for the information handling system. For example, the embedded controller data 507 may report a laptop or tablet physical configuration in some example embodiments for a convertible laptop device in some embodiments. In other embodiments, the embedded controller data 507 may report other usage configurations for reconfigurable information handling systems with a larger set of usage mode physical configurations as described in embodiments herein.

The antenna adaptation controller may also poll and receive proximity sensor data 505 such as from a variety of proximity sensors as described in embodiments herein. Antenna trigger data from the proximity sensors may yield a needed cutback in transmission power for a particular antenna system which will be taken into account by the antenna adaptation controller when determining selection of antenna radiation patterns or switching between available WLAN or WWAN antenna systems in accordance with embodiments herein.

Proceeding to 510, the antenna adaptation controller may access a truth table for WLAN or WWAN antenna operation to determine desired modifications to antenna radiation pattern steering or selection of antennas among WLAN or WWAN antenna options for shifting some or all transceiving operations depending on antenna trigger inputs and detected current state of WLAN or WWAN antenna function. For example, a series of WLAN antenna operation truth tables may exist if the WLAN or WWAN radio module is operating MIMO to expand data bandwidth across plural WLAN or WWAN antennas whereas different truth tables may operate if single stream WLAN or WWAN operation is an option. Further, status of operations of the WLAN or WWAN radio module including current power states for antenna transceiving, or existing antenna radiation patterns selected may be used to select a set of truth tables for determination potential changes to steering of WLAN or WWAN antennas or selection among WLAN or WWAN antennas by the antenna adaptation controller.

An example truth table is shown below:

| MCU Input Triggers | | | | Power cut back table | | | | | |
|---|---|---|---|---|---|---|---|---|---|
| Radiation | Tx/Rx | P- | | 2.4 GHz | | | 5 GHz | | |
| Mode | info | Sensor | EC | Low | Mid | High | Low | Mid | High |
| 1 | 1 | 1 | 1 | 2d B | 3 dB | 1 dB | 3 dB | 3 dB | 3 dB |
| 2 | 1 | 0 | 0 | 0 dB | 0 dB | 0 dB | 0 dB | 0 dB | 0 dB |
| 3 | 1 | 0 | 1 | 0 dB | 0 dB | 0 dB | 0 dB | 0 dB | 0 dB |
| 4 | 1 | 1 | 0 | 3 dB | 2 dB | 1 dB | 3 dB | 3 dB | 3 dB |

At 515, the antenna adaptation controller may adjust power for each channel on the WLAN or WWAN antennas based on received proximity sensor data 505 indicating a regulatory requirement that the power cutback be applied to at least one antenna system. For example, one or more proximity sensors may be deployed to indicate a user's proximity near one of the antenna systems. Further, the proximity may be combined with antenna trigger input data indicating the usage mode physical configuration which may impact the SAR requirement levels for the information handling system. For example, a tablet mode may have different SAR requirements than a laptop mode in some embodiments. The user proximity may also be detected relative to a particular WLAN or WWAN antenna such that antenna radiation pattern may be steered to away from the location of the sensed proximity in some example embodiments. Upon determining the power adjustments to the one or more WLAN or WWAN antenna systems, flow may proceed to 520.

At 520 the antenna adaptation controller may adapt the antenna pattern for operating WLAN or WWAN antennas of the information handling system as well as increase or decrease output power to any of the operating WLAN or WWAN antennas to improve the WLAN or WWAN wireless link quality. Each WLAN or WWAN antenna may have two or more potential antenna radiation patterns available which may be steered according to embodiments herein. Additionally, the antenna adaptation controller may also direct load levels among a plurality of available WLAN antenna systems operating depending on conditions measured for those WLAN or WWAN antennas.

In an example embodiment, if the WLAN or WWAN signal conditions are reported as having fallen below a threshold level of operation for a first WLAN or WWAN antenna system, the antenna adaptation controller may select a second antenna radiation pattern and steer the first WLAN or WWAN antenna to utilize the new pattern. The selection of the next antenna radiation pattern, if more than two are available, may be further selected based upon physical configuration data inputs, whether the first WLAN or WWAN antenna system has a user detected proximately, or based upon what the status indicates is the current antenna transmission pattern being used such that a different RF pattern may be selected. In yet another aspect, if a second or other WLAN or WWAN antenna system has a WLAN or WWAN radio signal condition better than the first WLAN or WWAN antenna system, the antenna adaptation controller may shift some or all of the wireless data flow and power to the better performing WLAN or WWAN antenna system or systems. The measurements may be retaken for WLAN or WWAN radio signal performance of a first WLAN or WWAN antenna channel relative to a threshold of performance or other WLAN or WWAN antenna channels and incremental changes may be made to further adapt the first WLAN or WWAN antenna system. For example, a different antenna radiation pattern may be selected by an antenna steering network such as those described in embodiments herein to determine if the next incremental adaptation improves the first WLAN or WWAN antenna performance and the overall WLAN performance across multiple WLAN or WWAN antennas available to the information handling system.

If a discrete number of WLAN or WWAN antennas and a discrete number of antenna radiation patterns are available as options for the WLAN or WWAN antennas, the antenna adaptation controller may incrementally cycle through each of them to compare overall performance of the WLAN or WWAN channel or channels being used and select an adapted configuration that is the best of the options in one embodiment. In other embodiments, reaching a threshold level of WLAN or WWAN performance may be the goal in which adaptations to WLAN or WWAN antenna traffic volumes, power levels, or antenna radiation patterns may be made among available WLAN or WWAN antennas until a threshold level of performance has been exceeded.

The antenna adaptation controller may monitor performance of the wireless adapter including operation of the WLAN or WWAN radio module, front end, and WLAN or WWAN antenna systems at 525. As explained, the antenna adaptation controller may remain idle but periodically poll the antenna trigger data system providers for updated information to monitor the ongoing performance of the WLAN or WWAN system in some embodiments. In other embodiments, as described above, the antenna adaptation controller may receive a signal, such as an interrupt signal, indicating a detected event by one or more of the antenna trigger data system providers needing attention an potential adaptation directed by the antenna adaptation controller at 525. If a next cycle of polling is reached for retrieving updated antenna trigger data or an interrupt signal is received to cause polling for antenna trigger data at 525, then flow may return to 502 to conduct polling of the antenna trigger input system providers. The flow may repeat for the antenna adaptation controller to assess whether power adjustments, pattern adaptation, or data volume adjustments are needed according to the most recent WLAN or WWAN signal conditions and other antenna trigger data reported in accordance with the embodiments herein.

If the next cycle of polling has not been reached for retrieving updated antenna trigger data or an interrupt signal has not been received to cause polling for antenna trigger data at 525, flow may proceed to 530 where the antenna adaptation controller detects if the information handling system is being powered down. If so, the process may end. If not, the antenna adaptation controller may return to 525 to continue monitoring the WLAN or WWAN signal conditions or changes to configuration, antenna status, or proximity detection with periodic polling or detection of an interrupt signal. The antenna adaptation controller may monitor for needed adaptations of the antenna systems for ongoing assessment for optimal WLAN or WWAN link quality for data throughput, signal quality, or other metrics.

It is understood that the methods and concepts described in the algorithm above for FIG. 5 may be performed in any sequence or steps may be performed simultaneously in some embodiments. It is also understood that in some varied embodiments certain steps may not be performed at all or additional steps not recited in the above figures may be performed. It is also contemplated that variations on the methods described herein may also be combined with portions of any other embodiments in the present disclosure to form a variety of additional embodiments.

Figure 6:
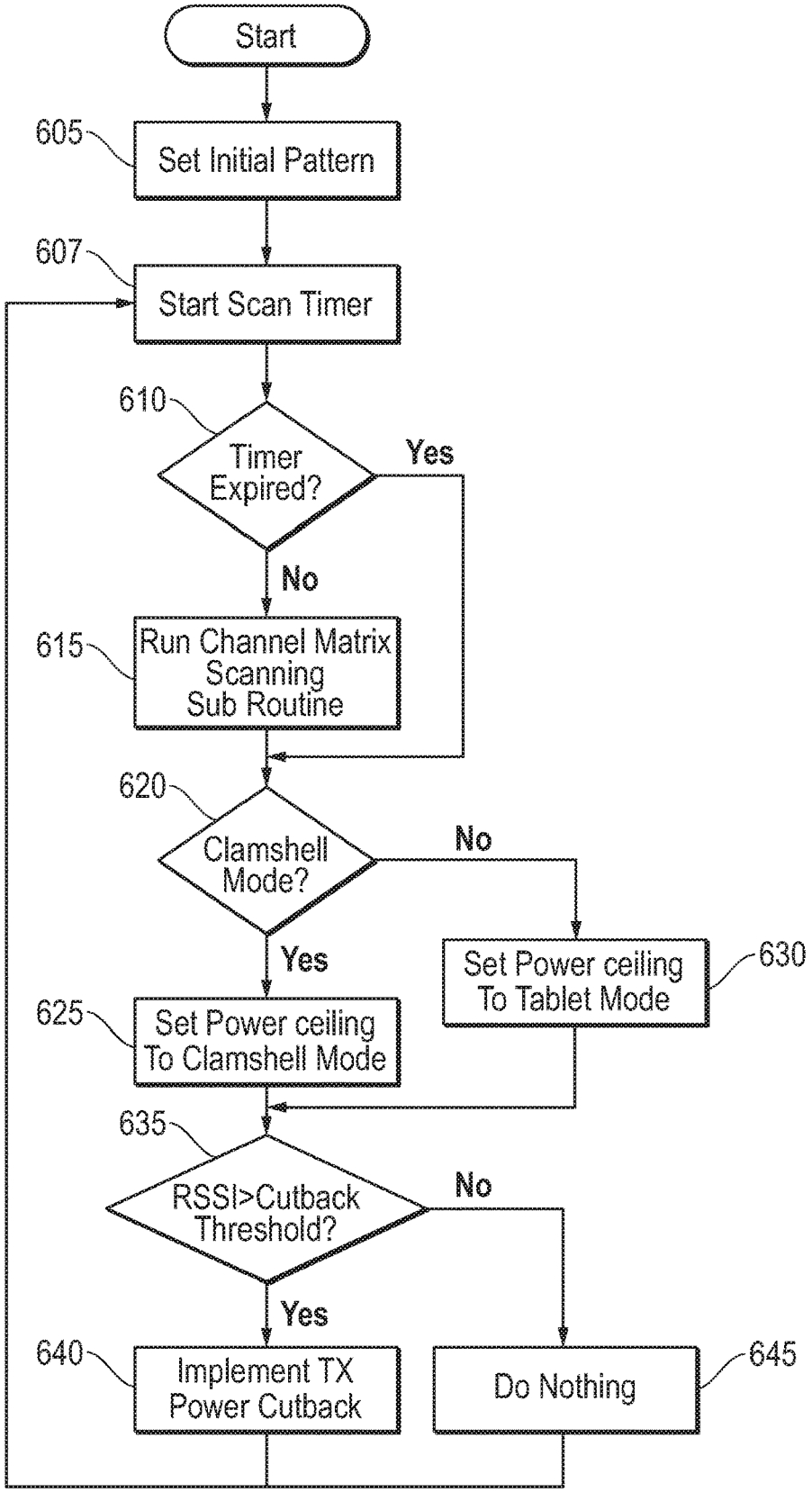
FIG. 6 is a flow diagram illustrating a method of operating an antenna adaptation controller for SAR power cutback levels according to another embodiment of the present disclosure.

FIG. 6 illustrates a method for determining antenna adjustments or modification to optimize operation WLAN antenna systems via operation of an antenna adaptation controller according to another embodiment. FIG. 6 is one example embodiment showing at least a partial iterative assessment of WLAN radio channels operating via a wireless adapter of an information handling system according to various embodiments herein. For example, the WLAN antenna systems may operate a 1×1, 2×2, or other MIMO operation across plural channels and WLAN antenna systems to maximize available wireless data throughput bandwidth. In an example embodiment, the antenna adaptation controller may scan a matrix of WLAN channels operating in a particular antenna radiation pattern.

At 605, the antenna adaptation controller may receive data setting the antenna transmission pattern for a WLAN antenna of the information handling system. Proceeding to 607, tThe antenna adaptation controller will start a scan timer to commence scanning WLAN signal quality levels such as RSSI, SNR, BER/FER, MCS, TX/RX throughput or other measured factors across available WLAN channels for wireless transmission. Proceeding to 610, if the scanning timer has not expired, the antenna adaptation controller will run a channel matrix scan subroutine for measuring and detecting metrics for each of the available channels on the WLAN antenna system at 615. Several metrics in addition to the above may be measured by the WLAN radio module. The WLAN radio module may store and then report the WLAN signal conditions to the WLAN antenna adaptation controller. Then flow will proceed to 620. If the timer for the assessment has expired at 610, the flow proceeds to 620. the antenna adaptation controller At 620, the antenna adaptation controller detects the usage mode physical configuration of the information handling system. Configuration data may be provided via the embedded controller or sensor hub discussed in embodiments herein. The antenna adaptation controller will determine if the information handling system is currently configured in the clamshell or laptop usage mode. A value of 1 returned from the embedded controller or sensor hub, for example, may indicate a laptop usage mode. In the present example embodiment, the information handling system may be a convertible laptop computer.

If the laptop mode is determined to be the selected physical configuration at 620, flow proceeds to 625. At 625, the antenna adaptation controller will set the power ceiling for the information handling system to be limited to maximum levels allowed for laptop systems under SAR regulations.

If the laptop mode is determined not to be the selected physical configuration at 620, flow proceeds to 630. At 630, the antenna adaptation controller will set the power ceiling for the information handling system to be limited to maximum levels allowed for tablet systems under SAR regulations. For example, the value 0 may be returned by the embedded controller or sensor hub indicating that the usage mode physical configuration is a tablet mode.

Proceeding to 635, the antenna adaptation controller will assess the measured WLAN signal metrics across the matrix of WLAN channels. In the shown embodiment, assessment of the received signal strength indicator (RSSI) is made. RSSI is the signal strength for each receiver channel when MIMO operation utilizes a plurality of WLAN channels. RSSI may be the primary measured feedback metric measured by the WLAN radio module and reported to the antenna adaptation controller when assessing antenna configuration performance. It is understood however that other antenna radio condition performance metrics may be used in other embodiments. In a particular embodiment, overall WLAN RSSI performance across the plurality of MIMO channels may be measured for a plurality of WLAN operating channels. In such a case, RSSI may be recorded for each channel or WLAN chain received. In an aspect, determining RSSI across plural WLAN channels is computed as a mean power of IQ (in phase, quadrature) baseband samples for each WLAN receiver chain. IQ baseband samples are down-converted baseband signals after RF front end processing by the wireless adapter. RF front end processing may include analog filtering, digital filtering, rate conversion and equalization filtering of a received baseband signal for a given bandwidth.

Other parameters may also be assessed at 635 including receiving reports on numbers of transmitted or received bytes or packets. This may be a valuable indicator of wireless link activity. Other parameters of wireless link radio conditions may be assessed as well including the access point identification and link state, modulation and coding schemes used, guard interval, numbers of spatial streams, and channel band-width. These aspects may be used in addition to or in place of RSSI in various combinations to assess link condition and WLAN system band-width capacity to enhance the system in determining WLAN antenna configuration by the WLAN antenna adaptation controller.

In the present embodiment, the RSSI reported for the WLAN channels for an antenna or antennas may be compared to a threshold level such as the "cutback threshold" as shown in 635. For example a cutback threshold of −73 may be used with an MCS of 1 and a transmission power of 18 dBm. If the RSSI is not greater than the cutback threshold at 635, then flow proceeds to 645 where the antenna adaptation controller will make no alterations. If the RSSI is greater than the cutback threshold at 635 however, flow may proceed to 640 where the antenna adaptation controller may implement a transmission power cutback to allow for more efficient operation of the WLAN antenna system without need for higher transmission power consumption.

Upon determining whether the RSSI is greater than the cutback threshold level for satisfactory radio channel conditions and whether transmission power cutback is useful, the flow may return to 610 to determine if a timer for scanning has expired. The process may repeat with the antenna adaptation controller continuing to monitor for changes in usage mode physical configuration indicators if the timer has expired at 610. If the timer has not expired, channel matrix scanning may be conducted at 615 in the event changes to power levels are necessary to configure the WLAN antenna or antennas for optimizing operation. Then the cycle of FIG. 6 may repeat in continuing to assess the WLAN antenna or antennas for an optimal antenna operating configuration.

It is understood that the methods and concepts described in the algorithm above for FIG. 6 may be performed in any sequence or steps may be performed simultaneously in some embodiments. It is also understood that in some varied embodiments certain steps may not be performed at all or additional steps not recited in the above figures may be performed. It is also contemplated that variations on the methods described herein may also be combined with portions of any other embodiments in the present disclosure to form a variety of additional embodiments.

Figure 7:
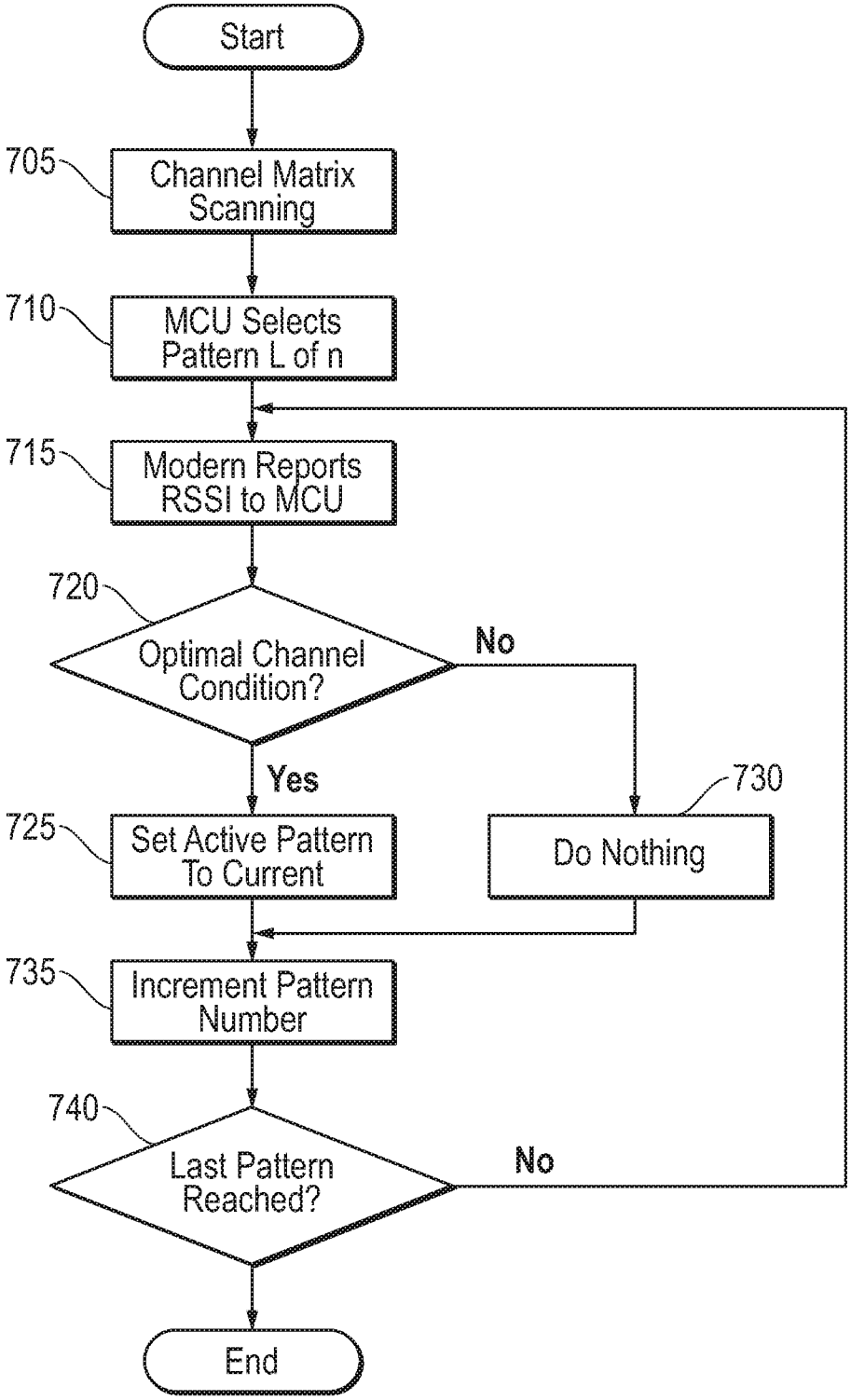
FIG. 7 is a flow diagram illustrating a method of operating an antenna adaptation controller for iterative radio pattern assessment according to another embodiment of the present disclosure.

FIG. 7 illustrates a method for determining antenna adjustments or modification to optimize operation WLAN antenna systems via operation of an antenna adaptation controller according to yet another embodiment. FIG. 7 is another example embodiment showing at least a partial iterative assessment of WLAN radio channels operating via a wireless adapter of an information handling system according to various embodiments herein. For example, the WLAN antenna systems may operate various types of MIMO operation across plural channels and WLAN antenna systems to maximize available wireless data throughput bandwidth. The antenna adaptation controller may be used to assess wireless transmission for each radiofrequency transmission pattern among those available via steering of the WLAN antenna or antennas and iterative assessment of the resulting signal conditions.

At 705, the antenna adaptation controller may scan a matrix of WLAN channels operating with a particular antenna radiation pattern. The antenna adaptation controller will initiate a WLAN radio module to commence scanning WLAN signal quality levels such as RSSI, SNR, MCS, TX/RX throughput or other measured factors across available WLAN channels. The antenna adaptation controller will run a channel matrix scan subroutine for measuring and detecting metrics for each of the available channels on the WLAN antenna system. Several WLAN signal condition metrics in addition to the above may be measured by the WLAN radio module. The WLAN radio module may store and then report the WLAN signal conditions to the antenna adaptation controller for the current configuration of the WLAN antenna or antennas including load distribution among channels and RF transmission pattern.

Proceeding to 710, the antenna adaptation controller may start with the current RF transmission pattern among those available for the WLAN. In an example aspect, the antenna adaptation controller may select one RF transmission pattern L out of n total available RF transmission pattern available for steering through an antenna adaptation network according to embodiments described herein. In example embodiments, utilization of control over coupling to various parasitic elements or phase shift adjustments to dipole feed coupling may be activated by the antenna adaptation controller via an antenna adaptation network to steer transmission shape profiles among several estimated options for a given antenna structure on the information handling system.

At 715, the WLAN radio module may report the measured RSSI levels of the WLAN channels or channels in configuration L pursuant to the channel matrix scan. Measurement of RSSI may be conducted according to methods understood by those of skill and described in parts in embodiments herein. Other WLAN radio condition metrics may also be reported to the antenna adaptation controller as described in various embodiments. These may include consideration of transceived byte or packet levels measured in some embodiments. Additional WLAN signal performance aspects may include SNR, MCS, NSS, guard interval, spatial stream numbers, channel bandwidths, link states, and access point connection identifications. These factors may be assessed along with other performance metrics such as RSSI or transceived data levels. For example, the number of spatial data streams, channel bandwidth, modulation scheme or other radio operational aspects reported may provide a basis on what value may be used as a threshold level of acceptable WLAN signal performance in some embodiments. These factors may also be used to determine how RSSI or other performance metrics are calculated, for example, across a mean set of values for a certain number of channels in other aspects.

The flow proceeds to 720, where the antenna adaptation controller will determine the operation of the WLAN system bandwidth and signal conditions given existing physical usage mode configuration and SAR power cutback requirements for the selected antenna transmission pattern. In one example embodiment, the RSSI or data throughput levels may need to achieve a minimum threshold level of operation at 720. If the RSSI or other WLAN signal condition metrics do meet a threshold level of measured performance at 720, then flow may proceed to 725 where the antenna adaptation controller sets the active transmission radiation pattern option L as the current transmission pattern to be selected for operation. Flow then proceeds to 735 to select another optional transmission pattern, for example L+1, for additional comparison.

If the RSSI or other WLAN signal condition metrics do not meet a threshold level of measured performance at 720, then flow may proceed to 730 where the antenna adaptation controller does not set the active transmission radiation pattern option as a current potential operative pattern. Flow proceeds to 735 to select another antenna radiation pattern for the WLAN antenna or antennas being assessed by the WLAN antenna adaptation controller.

At 735, the antenna adaptation controller will adjust the antenna adaptation network to steer one or more WLAN antenna systems to a second antenna RF transmission radiation pattern for conducting scanning and WLAN signal condition measurements for comparison of performance. A next RF transmission pattern may be selected from the n available pattern options for the WLAN antenna or antennas in operation.

At 740, the antenna adaptation controller will determine if the last incremental RF antenna pattern had been reached of the n pattern options in the last iteration of the cycle of FIG. 7. If the last pattern had already been reached, the method may end. If the last pattern had not been reached, flow may return to 715 where the WLAN radio module is queried to report RSSI or other signal condition metrics for the newly select RF transmission pattern to the WLAN antenna adaptation controller.

Flow then proceeds again to 720, where the antenna adaptation controller may compare the next selected antenna pattern to the WLAN signal condition metrics for the previously assessed RF pattern for the WLAN antenna or antennas. In an example embodiment, a comparison or one WLAN signal metric may be made between the currently assessed RF radiation pattern, such as L+1, to the previously assessed RF radiation pattern, such as L. In one example embodiment, the mean RSSI levels may be compared at 720.

If the newly assessed RF radiation pattern, for example L+1, has improved RSSI performance over the previously assessed RF radiation pattern, for example L, then flow proceeds to 725. The antenna adaptation controller will designate the currently assessed RF radiation pattern, such as L+1, to be the currently selected radiation pattern for WLAN radio operations if it proves to have better WLAN signal condition performance than the previously assessed RF radiation pattern. In some embodiments, the performance of an RF pattern option may also need to exceed a minimum threshold level of performance to be designated as the currently selected RF radiation pattern for WLAN radio operations at 725. In other embodiments, it is understood that other WLAN signal performance metrics may be used to determine whether optimal channel conditions have been met at 720. Further, in yet other embodiments, a matrix or weighted matrix of other WLAN signal performance metrics may be used to determine whether optimal channel conditions have been met at 720 or for setting threshold performance levels to define optimal channel conditions.

If the newly assessed RF radiation pattern, for example L+1, is not an improvement RSSI performance over the previously assessed RF radiation pattern, for example L, then flow proceeds to 730. The antenna adaptation controller maintains a designation of the previously assessed RF radiation pattern, such as L, to be the currently selected radiation pattern for WLAN radio operations if it proves to have better WLAN signal condition performance than the currently assessed RF radiation pattern. Flow will then proceed incrementally through the method of FIG. 7 until each of the RF radiation patterns, n, for the operational WLAN antenna or WLAN antennas have been assessed. At this point the process may end.

It is understood that the methods and concepts described in the algorithm above for FIG. 7 may be performed in any sequence or steps may be performed simultaneously in some embodiments. It is also understood that in some varied embodiments certain steps may not be performed at all or additional steps not recited in the above figures may be performed. It is also contemplated that variations on the methods described herein may also be combined with portions of any other embodiments in the present disclosure to form a variety of additional embodiments.

Figure 8:
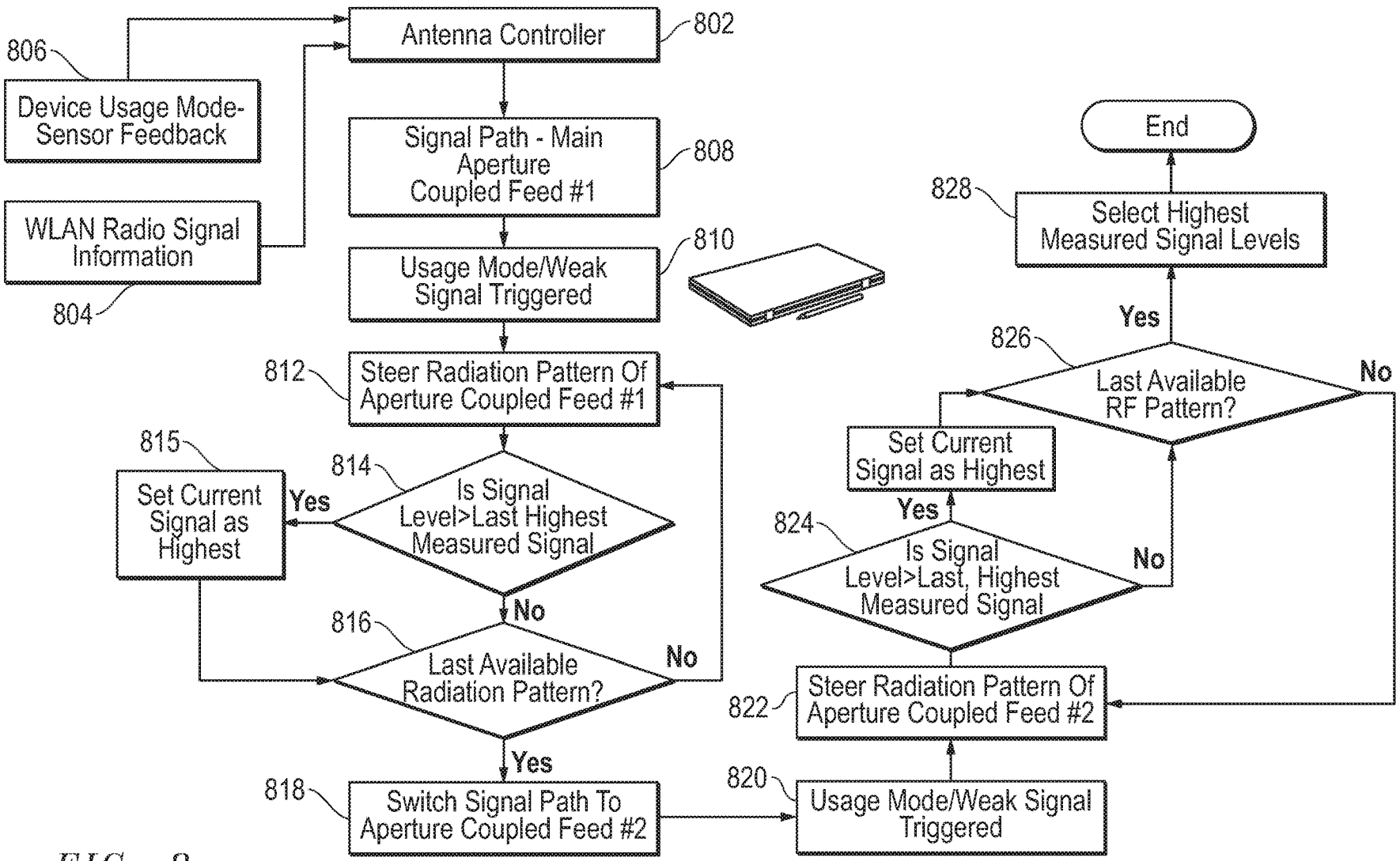
FIG. 8 is a flow diagram illustrating a method of operating an antenna adaptation controller for iterative radio pattern assessment according to yet another embodiment of the present disclosure.

FIG. 8 illustrates a method for determining antenna adjustments or modification to optimize operation WLAN antenna systems via operation of an antenna adaptation controller according to yet another embodiment. FIG. 8 is another example embodiment showing at least a partial iterative assessment of WLAN radio channels operating via a wireless adapter of an information handling system for selection of radiation patterns or between a plurality of antenna apertures available on an information handling system according to various embodiments herein. The antenna adaptation controller will initiate a WLAN radio module to commence scanning WLAN signal quality levels such as RSSI, SNR, MCS, TX/RX throughput or other measured factors across available WLAN channels for wireless transmission for each available radiofrequency transmission pattern among those available via steering of the WLAN antenna or antennas. This may be conducted according to various embodiments described herein.

The process beings at 802 where the antenna adaptation controller may receive antenna trigger inputs including device usage mode physical configuration feedback 806 and a scan a matrix of WLAN channels for WLAN signal condition feedback 804 for a particular antenna radiation pattern being used. Several WLAN signal condition metrics such as RSSI, SNR, MCS, TX/RX byte or packed levels may be measured by the WLAN radio module during a channel matrix scan. The WLAN radio module may store and then report the WLAN signal conditions to the antenna adaptation controller for the current signal path and radiation pattern.

At 808, the antenna adaptation controller receives status data that the WLAN radio module is operating on a first signal path with the main aperture in a first coupled feed to a WLAN antenna. In some embodiments, RFIC or other portions of the wireless adapter may report the status of the antenna adaptation network to report which radiation pattern is employed by the first signal path. Additionally, factors such as modulation, channel bandwidths, number of data streams, and the like may be received to set expected performance threshold levels and may also be necessary to obtain accurate performance metric determinations.

At 810, an assessment trigger is received by the antenna adaptation controller which may indicate a change in usage mode physical configuration 806 of the information handling system or an indication of a weak WLAN radio signal 804 for the first signal path. In response, at 812, the antenna adaptation controller may steer the radiation pattern of the first coupled aperture to a different radiation pattern. This may be done according to several embodiments described herein making adjustment to the phase shift network of the coupled feed for the first antenna system.

The antenna adaptation controller will determine if the WLAN signal condition for the altered antenna configuration radiation pattern has a stronger signal level relative to the previous signal level for the radiation antenna pattern signal level prior to steering at 812. In an example, an RSSI level closer to −51 dBm is a stronger signal, thus a comparison of RSSI levels between the previous antenna radiation pattern and the current antenna radiation pattern may be compared in one embodiment. A weak signal may be considered at −81 dBm. Other WLAN signal condition factors may be assessed instead or in addition to the RSSI measurement. For example, a comparison may be made of SNR levels or BER/FER levels between the previous and current antenna configuration before and after radiation pattern steering at 812. If the measured WLAN signal condition metric for the current antenna configuration is stronger than that of the previous antenna configuration signal level at 814, flow proceeds to 815 to designate the current antenna configuration and radiation pattern of aperture coupled feed #1 for the first WLAN signal path as the highest antenna configuration. Then flow may proceed to 816 to determine if additional radiation patterns are available at the first WLAN signal path. If the measured WLAN signal condition metric is not as strong as previous antenna configuration signal level at 814, flow proceeds to 816 to determine if additional radiation patterns are available at the first signal path. If additional antenna radiation patterns are still available in other antenna configurations for the first WLAN signal path, flow returns to 812 where the antenna adaptation controller steers the radiation pattern to yet another available pattern for the first antenna aperture along the first signal path. The WLAN signal level is assessed again at 814 relative to a set previous, highest measured signal level for a previous antenna configuration. This cycle may be repeated if the WLAN signal condition level is not strong enough at 814 compared previously measured levels of expected signal performance for other antenna configurations of first coupled WLAN feed. Expected signal performance measurements may depend on RF operation status data reported to the WLAN antenna adaptation controller.

If at 816, the last available variation of RF radiation pattern for the first WLAN signal feed has been assessed and the threshold level of WLAN signal has not been met, flow may proceed to 818. At 818, the antenna adaptation controller may switch the WLAN signal path to a second aperture coupled feed for a second antenna aperture. Similar to the assessment for the first WLAN signal path and first antenna, the antenna adaptation controller may conduct a WLAN signal condition scan 804 for the matrix of channels operating via the WLAN radio module. Further, a query may be sent for the device usage mode physical configuration data 806.

At 820, the antenna adaptation controller may detect a changed usage mode physical configuration 806 or a weak signal reported 804 from the WLAN radio module for the second signal path. Flow then proceeds to 822 where the antenna adaptation controller steers the radiation pattern to a new radiation pattern for the second coupled antenna aperture. The WLAN signal condition is assessed again in accordance with one or more embodiments described herein at 824. If the WLAN signal condition reported for the new RF radiation pattern assessed at 824 indicates a signal stronger than a previous signal level for expected performance of the previous antenna configuration for the second antenna aperture coupled feed, such as a measured RSSI, SNR, BER/FER or other metrics, the process may proceed to 825 to set the current measured signal level for the current second antenna aperture configuration as the highest measured level for the second aperture. Then flow may proceed to 826 to determine if additional RF patterns are available.

If the WLAN signal condition reported for the new RF radiation pattern indicates a signal weaker than a previously measured signal level at 824, such as an RSSI, SNR, BER/FER or other metrics indicating a weaker signal, the antenna adaptation controller proceeds to 826 while keeping the previous RF radiation pattern set as the highest measured signal level. At 826, the antenna adaptation controller determines if all RF radiation patterns for the second signal path have been tested. If not, flow returns to 822 to steer to another RF radiation pattern for the second coupled antenna aperture. If all radiation patterns have been tested at 826, flow may proceed to 828 where the antenna adaptation controller may select to use the RF radiation patterns set with the highest measured signal levels as the antenna configurations for both the first coupled antenna aperture and the second coupled antenna aperture. Further, in some embodiments, the signal levels measured between the highest signal levels may be compared as between the selected antenna configurations between the first coupled antenna aperture and the second coupled antenna aperture to determine which antenna feed may be preferable to use for WLAN signals. In other embodiments, both the first coupled antenna aperture and the second coupled antenna aperture may be used. In yet other embodiments, a change may be made to the RF radio transmission via the first signal path.

For example, an increase in power may be provided for transmission via either the first or second transmission paths.

With the above method of FIG. 8, for a two signal path 1×1 WLAN system, the antenna adaptation controller may continue to monitor and assess the WLAN signal conditions to ensure that the WLAN radio transmissions may operate at least at a minimum threshold signal strength level by selecting among the coupled antenna apertures for each signal path and assessing various RF radiation patterns available for each signal path. By doing so, the antenna adaptation controller may find an optimal antenna configuration and antenna location in view of the physical configuration of the information handling system and may find a sufficient antenna configuration and radiation pattern and may avoid the need to increase transmission power levels. This method can be extended to the 2×2 WLAN system, where the information handling system will have a plurality of apertures to switch to in view of the physical configuration of the system.

In other variations on the above embodiments, if it is determined that other signal paths with other RF radiation patterns are available, the method may proceed to a third signal path or even additional signal paths if such antenna systems are available in an information handling system It is appreciated how the antenna adaptation controller may proceed to assess a third or additional signal paths for an antenna configuration meeting the threshold WLAN signal performance threshold according to the method shown.

In yet other embodiments, if the first signal path and the second signal path RF radiation patterns have been assessed at 826, use of both the first coupled antenna aperture and the second coupled antenna aperture best performing configurations of the WLAN antenna or antennas may include altering load distribution among channels and signal paths as necessary to achieve enhanced WLAN RF channel performance levels between the first and second signal paths.

It is understood that the methods and concepts described in the algorithm above for FIG. 8 may be performed in any sequence or steps may be performed simultaneously in some embodiments. It is also understood that in some varied embodiments certain steps may not be performed at all or additional steps not recited in the above figures may be performed. It is also contemplated that variations on the methods described herein may also be combined with portions of any other embodiments in the present disclosure to form a variety of additional embodiments. For example, aspects of FIGS. 5-8 may be modified as understood by those of skill to implement variations described therein from either figure embodiment. In a particular aspect of the embodiments herein, the embodiments of FIGS. 5-8 may be modified for WWAN radio and antenna operation as understood such that WWAN antennas may be used in place of WLAN antennas, WWAN radio modules and performance metrics may be used instead of WLAN radio modules and performance metrics with antenna directivity steering applied as well to WLAN antenna systems in selection of enhanced antenna performance.

In some embodiments, dedicated hardware implementations such as application specific integrated circuits, programmable logic arrays and other hardware devices can be constructed to implement one or more of the methods described herein or portions of one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device). The device or module can include software, including firmware embedded at a device, such as an Intel® Core™ or ARM® RISC brand processors, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A wireless adapter front end for an information handling system comprising:

the information handling system having a display screen housing hinged to a base housing having a processor, memory, and power source;

a wireless adapter for communicating on a plurality antenna systems for connection to a plurality of wireless links;

an antenna configured to have a plurality of antenna radiation patterns via an antenna pattern steering control interface, wherein the antenna is operating in a first antenna radiation pattern;

an antenna adaptation controller executing code instructions configured to steer the antenna radiation pattern based upon a plurality of antenna trigger inputs, wherein the antenna trigger inputs include WLAN signal state feedback data and information handling system physical configuration data for configuration of the antenna system relative to the orientation of the display screen housing and the base housing of the information handling system;

the antenna adaptation controller configured to receive the antenna trigger inputs indicating the WLAN signal state and physical configuration of the antenna system relative to the orientation of the display screen and the base housing and selecting a second antenna radiation pattern for comparing WLAN radio link signal levels of the second antenna radiation pattern to the first antenna radiation pattern; and the antenna adaptation controller configured to select the second antenna radiation pattern as the highest if the WLAN radio link signal level of the second antenna radiation pattern is greater than the WLAN radio link signal level of the first antenna radiation pattern.

2. The wireless adapter front end of claim 1 wherein the antenna pattern steering control interface is configured to adjusts power between a plurality of parasitic elements in the antenna.

3. The wireless adapter front end of claim 1 wherein the antenna pattern steering control interface is configured to adjusts phase shift in coupling to the antenna.

4. The wireless adapter front end of claim 1, further comprising:

the antenna adaptation controller configured to receive the antenna trigger inputs and to select the second antenna radiation pattern further based on detecting a physical configuration state adjustment of the antenna system relative to the display screen and base housing of the information handling system.

5. The wireless adapter front end of claim 1 wherein the base housing of the information handling system includes a keyboard.

6. The wireless adapter front end of claim 1 wherein the base housing of the information handling system includes a second display screen.

7. The wireless adapter front end of claim 1, further comprising:

the antenna adaptation controller configured to receive the antenna trigger inputs including an indication from a proximity sensor of a condition requiring reduced transmission power levels to maintain specific absorption rate (SAR) limits while selecting the second antenna radiation pattern.

8. The wireless adapter front end of claim 1, further comprising:

a second antenna configured to have a plurality of antenna radiation patterns via an antenna pattern steering control interface, wherein the second antenna is configured to operate in a third antenna radiation pattern; and the antenna adaptation controller configured to identify which antenna radiation pattern among the plurality of antenna radiation patterns has the highest WLAN radio link signal level for the second antenna.

9. A computer implemented method comprising:

polling antenna trigger inputs including a WLAN module for WLAN signal state feedback data and an embedded controller for information handling system physical configuration data;

receiving the antenna trigger inputs at a WLAN antenna adaptation controller, wherein the antenna trigger inputs include WLAN signal state feedback data and information handling system physical configuration data for configuration of the antenna system relative to a display screen and base housing of the information handling system;

steering an antenna radiation pattern of an antenna configurable to have a plurality of antenna radiation patterns via an antenna pattern steering control interface for comparison of WLAN signal levels between the plurality of antenna radiation patterns; and selecting the antenna radiation pattern from the plurality of antenna radiation patterns with the highest WLAN radio link signal level.

10. The method of claim 9 wherein the antenna pattern steering control interface may adjust power between a plurality of parasitic elements in the antenna.

11. The method of claim 9 wherein the antenna pattern steering control interface may adjust phase shift in coupling to the antenna.

12. The method of claim 9 further comprising:

switching via the antenna adaptation controller to a second antenna if the WLAN radio link signal level of the second antenna is detected above the highest WLAN radio link signal of the antenna configurable to have a plurality of antenna radiation patterns.

13. The method of claim 9, further comprising:

receiving the antenna trigger inputs including an indication from a proximity sensor of a condition requiring reduced transmission power levels to maintain specific absorption rate (SAR) limits; and steering the antenna radiation pattern of an antenna configurable to have a plurality of antenna radiation patterns via an antenna pattern steering control interface further based on the reduced power transmission levels.

14. The method of claim 9, wherein the steering the antenna radiation pattern of the antenna further implements an impedance adjustment the antenna by adjust coupling RF currents to parasitic elements of the information handling system chassis.

15. A wireless adapter front end for an information handling system comprising:

a wireless adapter for communicating on a plurality antennas;

a first antenna configured to have a plurality of antenna radiation patterns via an antenna pattern steering control interface, wherein the first antenna is configured to operate in a first antenna radiation pattern;

an antenna adaptation controller configured to poll antenna trigger inputs including a WLAN module for WLAN signal state feedback data and an embedded controller for information handling system physical configuration data of the first antenna relative to an orientation of a first housing hinged to a second housing of the information handling system;

the antenna adaptation controller configured to determine whether a WLAN radio link signal level is measured indicating a weak signal for the first antenna radiation pattern;

the antenna adaptation controller executing code instructions configured to steer among the plurality of antenna radiation patterns via an antenna pattern steering control interface and parasitic elements of the first antenna system to alter the first antenna radiation pattern;

the antenna adaptation controller executing code instructions configured to compare WLAN radio link signal levels for the plurality of antenna radiation patterns and selecting a second antenna radiation pattern having a highest WLAN radio link signal level.

16. The wireless adapter front end of claim 1, further comprising:

the antenna adaptation controller configured to receive antenna trigger inputs including an indication from a proximity sensor of a condition requiring reduced transmission power levels to maintain specific absorption rate (SAR) limits for the first antenna.

17. The wireless adapter front end of claim 15 wherein the antenna adaptation controller is configured to poll antenna trigger inputs via I2C communication with the antenna adaptation controller or interrupt capable GPIO connections from the antenna trigger inputs to trigger I2C polling.

18. The wireless adapter front end of claim 15, further comprising:

the antenna adaptation controller configured to steer to the second antenna radiation pattern via the antenna pattern steering control interface and configured to receive a second set of antenna trigger inputs to determine if a WLAN radio link signal level for the second antenna radiation pattern exceeds the WLAN radio link signal level for the first antenna radiation pattern.

19. The wireless adapter front end of claim 15 wherein the embedded controller is configured to transmit information handling system physical configuration data relating to usage mode configuration of a display screen housing as the first housing relative to a base housing as the second housing which may include a keyboard or a portion of the display screen, wherein the display screen is foldable across both housings.

20. The wireless adapter front end of claim 15, further comprising:

a second antenna configured to have a plurality of antenna radiation patterns via an antenna pattern steering control interface; and the antenna adaptation controller configured to select the highest WLAN radio link signal level for an antenna radiation pattern among the plurality of antenna radiation patterns of the second antenna to use with the antenna radiation pattern with the highest WLAN radio link signal level for the first antenna.

* * * * *